US006699831B2

(12) United States Patent
Takano et al.

(10) Patent No.: US 6,699,831 B2
(45) Date of Patent: Mar. 2, 2004

(54) LIQUID DETERGENT COMPOSITION COMPRISING ALUMINOSILICATE OR CRYSTALLINE SILICATE

(75) Inventors: Tomoe Takano, Wakayama (JP); Koji Yui, Wakayama (JP); Takashi Oda, Wakayama (JP); Akira Ishikawa, Wakayama (JP); Osamu Takiguchi, Wakayama (JP)

(73) Assignee: Kao Corporation, Tokyo (JP)

( * ) Notice: Subject to any disclaimer, the term of this patent is extended or adjusted under 35 U.S.C. 154(b) by 152 days.

(21) Appl. No.: 09/875,096

(22) Filed: Jun. 7, 2001

(65) Prior Publication Data

US 2002/0013254 A1 Jan. 31, 2002

(30) Foreign Application Priority Data

| | | |
|---|---|---|
| Jun. 7, 2000 | (JP) | 2000-170274 |
| Jun. 7, 2000 | (JP) | 2000-170275 |
| Jan. 10, 2001 | (JP) | 2001-002366 |
| Mar. 5, 2001 | (JP) | 2001-059705 |

(51) Int. Cl.[7] ..... C11D 3/08; C11D 3/37

(52) U.S. Cl. ..... 510/511; 510/276; 510/315; 510/323; 510/338; 510/405; 510/407; 510/434; 510/475; 510/477; 510/485; 510/486; 510/507; 510/531; 510/532

(58) Field of Search ..... 510/276, 315, 510/323, 338, 405, 407, 434, 475, 477, 485, 486, 507, 511, 531, 532

(56) References Cited

U.S. PATENT DOCUMENTS

| | | | | |
|---|---|---|---|---|
| 4,326,979 A | | 4/1982 | Bus et al. | |
| 4,857,226 A | | 8/1989 | Drapier et al. | |
| 5,338,491 A | * | 8/1994 | Connor et al. | 252/548 |
| 5,354,491 A | * | 10/1994 | Bjorkquist et al. | 252/135 |
| 5,364,553 A | * | 11/1994 | Cao | 252/174.12 |
| 5,470,507 A | * | 11/1995 | Fredj et al. | 252/542 |
| 5,565,145 A | * | 10/1996 | Watson et al. | 510/350 |
| 5,723,426 A | * | 3/1998 | Zhen et al. | 510/337 |

FOREIGN PATENT DOCUMENTS

| | | |
|---|---|---|
| EP | 0 234 867 A2 | 9/1987 |
| EP | 0 385 521 A1 | 9/1990 |
| EP | 0 407 187 A2 | 1/1991 |
| EP | 0 459 077 A1 | 12/1991 |
| EP | 0 510 762 A2 | 10/1992 |
| EP | A2510762 | 10/1992 |
| EP | B1413616 | 3/1995 |
| EP | B1510762 | 6/1996 |
| EP | 1 004 655 A2 | 5/2000 |
| JP | B26039319 | 9/1985 |
| JP | A386800 | 4/1991 |
| JP | A5140599 | 6/1993 |
| JP | A7508781 | 9/1995 |
| JP | 10-237496 A | 9/1998 |
| WO | 9401524 | 1/1994 |

* cited by examiner

*Primary Examiner*—Charles Boyer
(74) *Attorney, Agent, or Firm*—Birch, Stewart, Kolasch & Birch, LLP

(57) ABSTRACT

The present invention provides a liquid detergent composition being excellent in detergency and dispersion stability and a process for producing the same. The invention provides a liquid detergent composition having a degree of separation by volume of 5% or less after storage for 1 month at 25° C., comprising a liquid phase as the phase (a), a polymeric dispersant as the component (b)] and at least one selected from the group consisting of a crystalline silicate compound and an aluminosilicate compound as the component (c), wherein the component (b) has a cation exchange capacity of not less than 120 $CaCO_3$ mg/g when the water content of the composition is 5% by weight or less and then the aluminosilicate compound only is used as the component (c) or when the water content of the composition is larger than 5% by weight.

13 Claims, No Drawings

LIQUID DETERGENT COMPOSITION COMPRISING ALUMINOSILICATE OR CRYSTALLINE SILICATE

TECHNICAL FIELD

The present invention relates to a liquid detergent composition useful in a wide variety of art fields such as cleaners including a washing detergent for fiber goods, a kitchen detergent, a household detergent and a hard-surface-washing detergent and a liquid cleanser.

PRIOR ARTS

The liquid detergent has such an advantage that it is generally superior in water solubility to powdery detergents, it is directly applicable to dirty portions, it needs no drying in production procedures, it can be compounded with thermally instable materials which cannot be incorporated into powdery detergents and it does not require any complicated instrument such as drying facilities.

Incorporation of an alkaline agent, a calcium scavenger, a bleaching agent, an enzyme, an abrasive etc. into the liquid detergent has been desired for supplementary effects. A liquid detergent containing solid components, however, maybe involved easily in problems such that the solid components precipitate and separate in storage, not easily re-dispersed again, and the product will have too high a viscosity to be easily poured into a laundry tank. In order to prevent the solid components from precipitating, increasing the viscosity of the liquid phase or reducing the particle diameter of solid matter has been used. Increasing the viscosity, however, is limited for pouring. It cannot assure a stable dispersion to reduce simply the particle diameter of the solid.

For the purpose of stabilizing a dispersion of solid components, it is known to use a polymeric dispersant to a liquid detergent composition: a copolymer of maleic anhydride and ethylene or vinyl methyl ether hydrolyzed at least at 30% in JP-B 60-39319; a polymer containing an amphiphatic carboxy group in JP-A 3-86800; a copolymer comprising a monomer containing a group being capable of extending from the surface of the solid phase and a monomer containing a group being capable of associating with the solid phase in JP-A 5-140599; and a polymer comprising a monomer showing self-association in the liquid phase and a monomer being soluble in the liquid phase in JP-A 7-508781. However, the solid components used in those reference compositions are stabilized with polymer network, but not satisfactory in dispersion stability.

DISCLOSURE OF INVENTION

The purpose of the present invention is to provide a liquid detergent composition being excellent in detergency and dispersion stability.

The inventors have found that the detergency is increased with a polymeric dispersant having a large cation exchanging capacity, that is, having a high calcium-capturing ability and an excellent stability is obtained with a polymeric dispersant having a good affinity with both liquid phase and solid phase.

When the water content of a detergent composition is 5 wt. % or less, a crystalline silicate compound works as an excellent alkaline agent and calcium-capturing agent. Therefore it has been found that an increased detergency and an excellent stability can be obtained with a polymeric dispersant having a good affinity with both liquid phase and solid phase.

The invention provides a liquid detergent composition, having a degree of separation by volume of 5% or less after 1 month of storage at 25° C., comprising a liquid phase as the phase (a), a polymeric dispersant as the component (b) and at least one selected from the group consisting of a crystalline silicate compound and an aluminosilicate compound as the component (c), wherein the component (b) has a cation exchange capacity of not less than 120 $CaCO_3$ mg/g when the water content of the composition is 5% by weight or less and then the aluminosilicate compound only is used as the component (c) or when the water content of the composition is larger than 5% by weight.

It is preferable that the content of the phase (a) is 30 to 95% by weight of the composition; the phase (a) comprises 10 to 100% by weight of a surfactant; the content of the component (b) is 0.1 to 10% by weight of the composition; the content of the component (c) is 3 to 69.9% by weight of the composition; the component (b) is a polymer consisting of 2 or more kinds of polymer chains; the component (b) is a block or graft polymer consisting of a polymer chain 1 being soluble or uniformly dispersible in the phase (a) and a polymer chain 2 having a functional group having a good affinity with the component (c); or the component (c) is the crystalline silicate compound.

The invention provides a process for producing the liquid detergent composition as defined above, which comprises a step of wet grinding the components (b) and (c) in the phase (a) to obtain a slurry of finely pulverized solid components.

The process may preferably comprise steps of wet grinding the component (c) in the phase (a) to obtain a slurry of finely pulverized solid component and adding the component (b) to the slurry. It is preferable in the process that the total volume of the phase (a), the component (c) and other solid components is 0.9 to 1.1 times as much as the volume of gaps of media introduced into a media mill at the step of the wet grinding.

DETAILED DESCRIPTION OF INVENTION

Phase (a): Liquid Phase

The content of the phase (a) as the liquid phase of the liquid detergent composition is preferably 30 to 95% by weight, more preferably 40 to 90% by weight. The content of the phase (a) can be determined by sedimenting the solid of the liquid detergent composition (separating conditions: 10,000 rpm, 30 minutes, 25° C.) with a centrifuge, himac CR22F (tradename) produced by Hitachi, Ltd., and then quantifying the filtrate from which the sedimented components have been removed through a 0.1 $\mu$m membrane filter at 25° C., made of PTFE, produced by ADVANTEC Co., Ltd.

The phase (a) comprises a surfactant as an essential ingredient and if necessary water and a water-soluble organic solvent. The phase (a) may contain water. In order to compact the detergent composition, however, the content of water of the phase (a) may be preferably 60% by weight or less and the phase (a) may be more preferably a non-aqueous liquid phase not containing water substantially. The non-aqueous liquid system means that water is not intentionally added and further the content of water of the liquid detergent composition is preferably 5% by weight or less, more preferably 2% by weight or less.

The content of the surfactant of the phase (a) is preferably 10 to 100% by weight, more preferably 50 to 100% by weight or particularly preferably 60 to 100% by weight.

The surfactant is preferably a nonionic surfactant. Insofar as the stability of the product is not deteriorated, an anionic surfactant, a cationic surfactant or an amphoteric surfactant may be used with the nonionic surfactant by dissolving it in the phase (a). The phase (a) is also preferably a nonionic surfactant.

a-1: Nonionic Surfactant

A nonionic surfactant is conventionally incorporated for use in a detergent composition and advantageously provides an excellent detergency and stability. The content of the nonionic surfactant in the surfactants is preferably 70 to 100% by weight, more preferably 90 to 100% by weight and particularly preferably 100% by weight.

As the nonionic surfactant, the known nonionic surfactants described in e.g. "3-1. Collection of Well Known and Customary Techniques (Powder Detergent for Clothing)" published by the Japanese Patent Office can be used.

In the liquid detergent composition of the present invention, it is particularly preferable to use a polyethylene oxide- and/or polypropylene oxide-including nonionic surfactant. It is in particular at least one selected from a polyoxyethylene alkyl ether comprising 5 to 20 moles on the average of ethylene oxide added to a $C_{8-18}$ linear or branched, primary or secondary alcohol and a polyoxyethylene polyoxypropylene alkyl ether comprising 5 to 15 moles on the average of ethylene oxide and 1 to 5 moles on the average of propylene oxide added thereto, the ethylene oxide and propylene oxide having been added in random or in block.

As other nonionic surfactants, it is also possible to use polyoxyethylene alkyl phenyl ethers, polyoxyethylene alkyl amines, sucrose fatty esters, fatty acid glycerol monoesters, higher fatty acid alkanol amides, polyoxyethylene higher fatty acid alkanol amides, amine oxides, alkyl glycosides, alkyl glyceryl ethers and N-alkyl gluconamides.

a-2: Anionic Surfactant

The known anionic surfactants described in e.g. "3-1. Collection of Well Known and Customary Techniques (Powder Detergent for Clothing)" published by the Japanese Patent Office can be used in the liquid detergent composition of the present invention. In particular, anionic surfactants such as sulfonates, sulfates, phosphates and carboxylate are preferably incorporated into it.

An example of the anionic surfactant may be preferably at least one selected from alkyl benzene sulfonates, alkyl sulfates, polyoxyethylene alkyl ether sulfates having the average mole number of ethylene oxide added of 0.5 to 6, monoalkyl phosphates and fatty acid salts, having a linear or branched alkyl or alkenyl group containing 8 to 22 carbon atoms on the average.

The counter ion to the anionic surfactant may include sodium, potassium, magnesium, calcium, a cation such as ethanolamine whose amine has been protonated, quaternary ammonium salts and mixtures thereof. The anionic surfactant may be incorporated by adding it in the acid form and separately adding an alkali such as ethanolamine thereto.

a-3: Cationic Surfactant

The known cationic surfactants described in e.g. "3-1. Collection of Well Known and Customary Techniques (Powder Detergent for Clothing)" published by the Japanese Patent Office can be used in the liquid detergent composition of the present invention. For example quaternary ammonium salts such as benzalconium may be preferably incorporated.

a-4: Amphoteric Surfactant

The known amphoteric surfactants described in e.g. "3-1. Collection of Well Known and Customary Techniques (Powder Detergent for Clothing)" published by the Japanese Patent office can be used in the liquid detergent composition of the present invention. For example alkyl betain-based amphoteric surfactants may be preferably incorporated.

a-5: Water-Soluble Organic Solvent

The water-soluble organic solvent is incorporated into the present liquid detergent composition for the purposes of regulating the viscosity of the product, preventing gelation of the nonionic surfactant and regulating the solubility of the composition in washing water.

Examples of such water-soluble organic solvents may include polyhydric alcohols such as butanediol, pentanediol, hexanediol, glycerol, trimethylol propane and pentaerythritol, mono-, di- or tri-alkyl ethers of polyhydric alcohols, glycols such as ethylene glycol, propylene glycol, polyethylene glycol and polypropylene glycol, monoalkyl ethers of glycols, monoaryl ethers of glycols, monophenyl ethers of glycols, polyethers, alkylamines, fatty amines, aliphatic or aromatic carboxylic acid amides or alkyl esters, lower alkyl esters, ketones, aldehydes, glycerides etc.

These organic solvents may be incorporated singly or as a mixture thereof. For detergency and for compacting the detergent composition, the content thereof in the phase (a) is preferably 0 to 90% by weight, more preferably 0 to 50% by weight and particularly preferably 0 to 40% by weight.

Component (b): Polymeric Dispersant

The polymeric dispersant has an excellent solubility or a uniform dispersibility to the phase (a) and gives a stable dispersibility to the solid component including the component (c).

In order to achieve a good dispersibility or prevent the viscosity from increasing too much, the content of the component (b) as the polymeric dispersant in the liquid detergent composition is preferably 0.1 to 10% by weight, more preferably 0.1 to 5% by weight and particularly preferably 0.1 to 3% by weight.

The component (b) is soluble or uniformly dispersible in the phase (a). This property can be realized by placing 2 g as the dried of the polymer in a 300 ml beaker, pouring 36.8 g of the phase (a) component into it, stirring it at 150 rpm with a Teflon-coated magnet (3 cm) for 5 hours under heating at 50° C., cooling it, allowing it to stand for 30 minutes at 25° C., and observing no precipitates at the bottom of the beaker.

The component (b) gives the solid including the component (c) a stable dispersibility. The stable dispersibility means that after the liquid detergent composition of the present invention has been produced, the degree of separation by volume after 1 months of storage at 25° C. is 5% or less. The degree of separation by volume refers to a ratio of the volume of a transparent liquid phase separated by precipitation of the solid components to the total volume of the composition. It can be specifically measured by the method described below.

The invention provides a liquid detergent composition, having a degree of separation by volume of 5% or less after 1 month of storage at 25° C., comprising a liquid phase as the phase (a), a polymeric dispersant as the component (b) and a crystalline silicate compound and/or an aluminosilicate compound as the component (c), wherein the component (b) has a cation exchange capacity of not less than 120 $CaCO_3$ mg/g, preferably not less than 150 $CaCO_3$ mg/g, more preferably not less than 180 $CaCO_3$ mg/g, when the water content of the composition is 5% by weight or less and then the aluminosilicate compound only is used as the component (c) or when the water content of the composition is larger than 5% by weight.

The larger the cation exchanging capacity is, the more increased detergency the detergent has.

A particularly preferable liquid detergent composition has a degree of separation by volume of 5% or less after 1 month of storage at 25° C. and comprises a liquid phase as the phase (a), a polymeric dispersant as the component (b) having a cation exchange capacity of not less than 120 $CaCO_3$ mg/g, preferably not less than 150 $CaCO_3$ mg/g and more preferably not less than 180 $CaCO_3$ mg/g, and a crystalline silicate compound and/or an aluminosilicate compound as the component (c). The cation exchanging capacity of the component (b) may be 320 $CaCO_3$ mg/g or less.

As used herein, the cation exchange capacity is a value determined in the following method. About 0.1 g of the component (b) is accurately weighed and dissolved in 100 ml of 0.1 M $NH_4Cl$—$NH_4OH$ buffer at pH 10. The solution is kept at 25° C. and titrated with a calcium ion solution containing 20,000 ppm as $CaCO_3$ at pH 10 while the electric potential is measured. The concentration of calcium ion remaining in the solution is estimated from the relationship between the volume of the dropwise added solution and the potential changes. The amount of captured calcium ion is calculated. The amount of captured calcium ion as determined by this method is expressed in term of cation exchange capacity.

The component (b) is preferably a polymer consisting of two or more kinds of polymer chains, including polymer chains being soluble or uniformly dispersible in the phase (a) described above and polymer chains giving the solid components including the component (c) a stable dispersibility. It is more preferably a block or graft polymer.

It is in particular preferably a polymer having polymer chains being soluble or uniformly dispersible in the phase (a), polymer chains having a functional group having a good affinity with the component (c) and polymer chains consisting mainly of a vinyl monomer having a carboxyl group effectively to capture calcium, preferably having a cation exchange capacity of not less than 120 $CaCO_3$ mg/g as determined by the above method. In the polymer chains, the monomer(s) of one polymer chain may overlap with that of another polymer chain.

As the monomers forming polymer chains being soluble or uniformly dispersible in the phase (a), at least one selected the following monomers (1) to (13) can be used. There is no particular limitation. The monomers (1) and (2) principally produce polymer chains showing a good solubility in the phase (a) of the liquid detergent composition having a water content of larger than 5% by weight of the whole composition, due to a relatively good affinity to water. The monomers (3) to (13) principally produce polymer chains showing a good solubility in the phase (a) of the liquid detergent composition having a water content of 5% by weight or less of the whole composition, due to a relatively good affinity to surfactants and water-soluble organic solvents.

(1) Vinyl monomer having a sulfonic acid group. For example, styrenesulfonic acid or a salt thereof, 2-acrylamide-2-methylpropanesulfonic acid or a salt thereof and (meth)allyl sulfonic acid or a salt thereof are preferable.

(2) Vinyl monomer having a cation group. For example, 2-[(meth)acryloyloxy]ethyl trimethyl ammonium chloride, vinyl benzyl trimethyl ammonium chloride, ethyl sulfate 2-[(meth)acryloyloxy]ethyldimethyl ethyl ammonium, 3-[(meth)acrylamide]propyl trimethyl ammonium chloride, diallyl dimethyl ammonium chloride, etc. are preferable.

(3) Vinyl ether having a $C_{1-22}$ unsubstituted or substituted, saturated or unsaturated alkyl, aryl or aralkyl group. For example, methyl vinyl ether, ethyl vinyl ether, 4-hydroxybutyl vinyl ether, phenyl vinyl ether, etc. are preferable.

(4) (Meth)acrylamide unsubstituted or substituted on the nitrogen atom thereof with $C_{1-12}$ saturated or unsaturated alkyl or aralkyl group. For example, (meth)acrylamide, N-methyl(meth)acrylamide, N,N-dimethyl(meth)acrylamide, N-ethyl(meth)acrylamide, N-t-butyl(meth)acrylamide, N-(meth)acryloyl morpholine, N-[2-(N,N-dimethylamino)ethyl](meth)acrylamide, N-[3-(N,N-dimethylamino) propyl](meth)acrylamide, N-[2-hydroxyethyl](meth)acrylamide, N-methylol(meth)acrylamide, N-butoxymethyl(meth)acrylamide, etc. are preferable.

(5) N-vinyl fatty amide. For example, N-vinyl pyrrolidone, N-vinyl acetamide, N-vinyl formamide, etc. are preferable.

(6) (Meth)acrylate having $C_{1-22}$ unsubstituted or substituted, saturated or unsaturated alkyl or aralkyl group. For example, methyl(meth)acrylate, ethyl(meth)acrylate, 2-hydroxyethyl (meth)acrylate, 2-(N,N-dimethylamino) ethyl(meth)acrylate, 2-methoxyethyl(meth)acrylate, polyethylene glycol mono(meth)acrylate, etc. are preferable.

(7) Alkylene oxide. For example, ethylene oxide, propylene oxide, etc. are preferable.

(8) Cyclic imino-ether. For example, 2-methyl-2-oxazoline, 2-phenyl-2-oxazoline, etc. are preferable.

(9) Styrene. For example, styrene, 4-ethyl styrene, α-methyl styrene, etc. are preferable.

(10) Vinyl ester. For example, vinyl acetate, vinyl caproate, etc. are preferable.

(11) Polyester consisting of dihydric alcohol and dibasic carboxylic acid. For example, a polycondensate product of polyethylene glycol and terephthalic acid or 1,4-butanediol and succinic acid, etc. are preferable.

(12) Polyamide. For example, a ring-opening polymerization product of N-methyl valerolactam is preferable.

(13) Polyurethane. For example, a polyaddition product of polyethylene glycol, hexamethylene diisocyanate and N-methyl-diethanolamine or 1,4-butanediol, etc. are preferable.

The constituting units of the above shown monomers may be contained in the polymer chains in an amount of 60 mole percent or more in order to have a solubility or a uniform dispersibility in the phase (a), preferably 80 mole percent or more, more preferably 90 mole percent or more, the most preferably 100 mole percent. A monomer being copolymerizable with them may be added.

The functional group having a good affinity with the component (c) may include carboxyl group, sulfonic acid group, phosphoric acid group, hydroxy group, primary to tertiary amino groups, quaternary ammonium group etc. As the monomers forming polymer chains having a good affinity-having (lipophilic) group with the component (c), it is possible to use one or more members selected from (meth)acrylic acid and salts thereof, styrene carboxylic acid and salts thereof, maleic acid and salts thereof, itaconic acid and salts thereof, styrenesulfonic acid and salts thereof, (meth)allyl sulfonic acid and salts thereof, 2-acrylamide-2-methylpropanesulfonic acid and salts thereof, vinyl sulfonic acid and salts thereof, vinyl alcohol, 2-hydroxyethyl(meth)acrylate, N-[2-hydroxyethyl](meth)acrylamide, 4-hydroxymethyl styrene, mono-2-[(meth)acryloyloxy]ethyl phosphate, 2-[(meth)acryloyloxy]ethyl trimethyl ammonium chloride, vinyl benzyl trimethyl ammonium chloride, 2-[(meth)acryloyloxy]ethyl dimethyl ethyl ammonium ethyl sulfate, 3-[(meth)acrylamide]propyl trimethyl ammonium chloride, diallyl dimethyl ammonium chloride, vinyl pyridine, etc.

The constituting units of the above shown monomers may be contained in the polymer chains in an amount of 60 mole percent or more in order to have a good affinity with the phase (c), preferably 80 mole percent or more, more preferably 90 mole percent or more, the most preferably 100 mole percent. A monomer being copolymerizable with them may be added.

The monomers forming polymer chains consisting mainly of a vinyl monomer having a carboxyl group effectively to capture calcium, include (meth)acrylic acid and salts thereof, styrene carboxylic acid and salts thereof, maleic acid and salts thereof, and itaconic acid and salts thereof. One or more members selected from these monomers can be used.

The constituting units of the above shown monomers may be contained in the polymer chains in an amount of 60 mole percent or more in order to capture calcium very well, preferably 80 mole percent or more, more preferably 90 mole percent or more, the most preferably 100 mole percent. A monomer being copolymerizable with them may be added.

These polymer chains consisting mainly of a vinyl monomer having a carboxyl group also have a high affinity with the component (c) and the component (b) including these polymer chains no longer needs any other polymer chains having a high affinity with the component (c).

The component (b) is more preferably a block or graft polymer comprising a polymer chain being soluble or uniformly dispersible in the phase (a) (referred to hereinafter as polymer chain 1) and a polymer chain having a functional group with a high affinity to the component (c) (referred to hereinafter as polymer chain 2). In a particularly preferable component (b), the polymer chain with a high affinity to the component (c) is a polymer chain derived from a vinyl monomer having a carboxyl group.

By the presence of the two polymer chains, performances of both are effectively achieved. To demonstrate effective performances of both, the polymer is particularly preferably a graft polymer. The proportion of the two polymer chains by weight, that is, (polymer chain 1)/(polymer chain 2), is preferably from 5/95 to 95/5. The method of synthesizing such block or graft polymer is not particularly limited and a known method can be selected. In particular, a method of polymerizing a vinyl monomer etc. by means of a macro-azo initiator having an azo group in the polymer chain thereof (macro-azo initiation method), a method of using a compound having a polymerizable group at one end of the polymer chain thereof (macro-monomer method), a method of linking a newly formed polymer chain by chain transfer reaction to a previously coexistent polymer chain (chain transfer method), and a method of linking the terminal of one polymer chain through reaction to a functional group in the other polymer chain are preferable.

Preferable examples of the component (b) obtained in these methods include the followings 1 to 12:

1. A block polymer obtained by radical polymerization of (meth)acrylic acid (or a salt thereof) by use of a polyethylene glycol macro-azo initiator.
2. A copolymer of polyethylene glycol mono(meth)acrylate and (meth)acrylic acid (or a salt thereof).
3. A copolymer of polyethylene glycol mono(meth)acrylate and styrenesulfonic acid (or a salt thereof).
4. A copolymer of polyethylene glycol mono(meth)acrylate and 2-((meth)acryloyloxy)ethyltrimethyl ammonium chloride.
5. A copolymer of polyethylene glycol mono(meth)acrylate and 2-hydroxyethyl(meth)acrylate.
6. A graft polymer obtained by radical polymerization of acrylic acid and maleic acid (or a salt thereof) in polyethylene glycol, polypropylene glycol or polyethylene glycol-propylene glycol.
7. A graft polymer obtained by radical polymerization of diallyl dimethyl ammonium chloride in an aqueous solution of poly(N,N-dimethyl acrylamide/styrene) copolymer.
8. A graft polymer obtained by radical polymerization of 2-acrylamide-2-methyl-propanesulfonic acid (or a salt thereof) in an aqueous solution of poly(N,N-dimethyl (meth)acrylamide).
9. A graft polymer obtained by linking poly(meth)acrylic acid through dehydration reaction to polyethylene glycol having hydroxyl group at the terminal thereof.
10. A graft polymer obtained by radical polymerization of acrylic acid and maleic acid (or a salt thereof) in an aqueous solution of polystyrene sulfonate.
11. A graft polymer obtained by radical polymerization of diallyl dimethyl ammonium chloride in an aqueous solution of poly(acrylic acid/maleic acid).
12. A graft polymer obtained by radical polymerization of polyethylene glycol allyl ether and maleic acid.

In the above shown (co)polymers 1 to 12, those having the polyethylene glycol units may have an alkoxy group such as methoxy.

Particularly preferable polymers among those described above are polymers 1, 2, 6, 9 and 12.

When the content of water of the liquid detergent composition of the present invention is 5% by weight or less, the polymers 2, 6, 12, 9, 1 and other polymers are increasingly less preferable in this order. The polymer 2 is the most important. These polymers have a relatively high solubility and/or uniform dispersibility in the liquid phase in the case of 5 wt. % or less of water.

When the content of water therein is larger than 5% by weight, the polymers 10, 6, 2, 12, 9 and other polymers are increasingly less preferable in this order. 10 is the most preferable. These polymers have a relatively high solubility and/or uniform dispersibility in the liquid phase in the case of larger than 5 wt. % of water.

The polymers 2, 6, 12 and 9 have a good affinity to both liquid phases.

The salt of the component (b) preferably includes a basic amino acid salt, an alkali metal salt such as sodium salt and potassium salt, an ammonium salt and an alkanol ammonium salt having the total carbon number of 1 to 12. The alkali metal salt is more preferable. The sodium salt is much more preferable.

For preventing too much an increase in the viscosity, the weight average molecular weight of the component (b) is preferably 1,000,000 or less, more preferably 1000 to 500,000, particularly preferably 5000 to 300,000.

Component (c): Crystalline Silicate Compound and/or Aluminosilicate Compound

The component (c) is at least one member selected from a crystalline silicate compound and an aluminosilicate compound, and the total content thereof in the liquid detergent composition is preferably 3 to 69.9% by weight, more preferably 10 to 60% by weight.

The crystalline silicate compound includes those compounds represented by formula (I):

$$(M^1_pM^2_qM^3_rO)(M^4_sM^5_tO)_x(SiO_2)_y \quad (I)$$

wherein $M^1$, $M^2$ and $M^3$ represent Na, K or H; $M^4$ and $M^5$ each represent Ca or Mg; p, q and r each represent a number of 0 to 2, provided that p+q+r=2; s and t each represent a number of 0 to 1, provided that s+t=1; x is a number of 0 to 1; and y is a number of 0.9 to 3.5.

Specifically, the crystalline silicate compound includes layered sodium silicate, for example SKS-6 (Hoechst) and those described in claims in Japanese Patent No. 2525318, Japanese Patent No. 2759243, Japanese Patent No. 2618799, Japanese Patent No. 2525342, and JP-A 5-184946.

Further, the aluminosilicate compound includes those compounds represented by formula (II):

$$(M^1_pM^2_qM^3_rO)_u(M^4_sM^5_tO)_v(Al_2O_3)_w(SiO_2) \quad \text{(II)}$$

wherein $M^1$, $M^2$, $M^3$, $M^4$, $M^5$, p, q, r, s and t have the same meanings as defined above; u is a number of 0 to 1, preferably 0.1 to 0.5; v is a number of 0 to 1, preferably 0 to 0.1; and w is a number of 0 to 0.6, preferably 0.1 to 0.5.

Such aluminosilicate compounds include e.g. various zeolites of types A, X and P, used conventionally in detergents, and in particular type A is preferable. A zeolite has a high cation exchange ability and is thus a very excellent builder for detergent, and the incorporation thereof is preferable because the detergency of the resulting detergent composition is significantly improved. Such zeolites include Toyo Builder (tradename) commercially available from Tosoh Corporation. Further, fine zeolites produced by the method described in JP-A 11-318604 are also preferably used because in the process for producing the present detergent composition as described below they are easily finely ground whereby the dispersion stability of the composition is improved. Generally, commercial zeolites contain about 20% water. For production of the liquid detergent composition not substantially containing water, it is preferable that such commercial zeolites are used after water has been removed by calcination at 450 to 600° C.

The average particle diameter of the component (c) is 500 μm or less, preferably 0.1 to 20 μm, more preferably 0.1 to 2 μm, and particularly preferably 0.1 to 1.0 μm. Unless otherwise specified, the average particle diameter refers to an average particle diameter on volume basis as determined by a laser scattering particle size distribution analyzer, LA-910 manufactured by Horiba, Ltd.

Other Components (d)

The liquid detergent composition of the present invention can further comprise, as other components, a surfactant being insoluble in the phase (a), an inorganic builder, an organic builder, a bleaching agent and other conventional additives to detergent.

If these components are solids, these components similar to the component (c) can be finely pulverized, dispersed, and incorporated into the present detergent composition in the method described below. In this case, the average particle diameter of each solid component is preferably 500 μm or less, preferably 0.1 to 20 μm, more preferably 0.1 to 2 μm, and particularly preferably 0.1 to 1.0 μm.

d-1: Surfactant Insoluble in the Phase (a)

The liquid detergent composition of the present invention comprises a surfactant in the phase (a), and then separately another surfactant being insoluble in the phase (a) may be dispersed and incorporated as a solid component.

d-2: Inorganic Builder

Besides the component (c), known washing builders such as silicates, metasilicates and carbonates can be arbitrarily compounded. These are preferably alkaline metal salts.

For example, phosphates such as tripolyphosphates and pyrophosphates, aminotri(methylene phosphonic acid), 1-hydroxyethylidene-1,1-diphosphonic acid, ethylene diamine tetra(methylene phosphonic acid), diethylene triamine penta(methylene phosphonic acid) or salts thereof can also be used.

d-3: Organic Builder

The liquid detergent composition of the present invention can also comprise known organic builders being soluble or insoluble in the phase (a). Examples of such organic builders include polybasic carboxylic acids such as citric acid, succinic acid and malonic acid, amino acids such as aspartic acid and glutamic acid, amino polyacetic acids such as nitrilo triacetic acid and ethylene diamine tetraacetic acid, and polymeric polybasic carboxylic acids such as polyacrylic acid, acrylic acid/maleic acid copolymers etc. These are preferably in the form of salts such as alkaline metal salts, ammonium salts and substituted ammonium salts.

d-4: Bleaching Agent

Further, the liquid detergent composition of the present invention preferably comprises a bleating agent. As the bleaching agent, an inorganic peroxide bleaching, or an inorganic peroxide bleaching agent combined with a bleach-activating agent, can be used.

Examples of the inorganic peroxide bleaching agent are alkali metal perborates, percarbonates, persilicates and perphosphates, particularly preferably sodium perborate, sodium percarbonate etc. For improving the dispersion stability of the product, percarbonates coated with carboxylic acid type polymers and/or polycarboxylic acids mentioned in lines 13 to 44 in column 2 on page 2 in JP-A 11-279593 can be used.

If the inorganic peroxide bleaching agent is used in combination with a bleach-activating agent, the bleach-activating agent is usually an organic compound having one or more reactive acyl groups forming peracid, by which the bleaching action is rendered more effective than by using the inorganic peroxide bleaching agent singly. Although the structure of the bleach-activating agent is not particularly limited, it is preferably the one shown in formula (III):

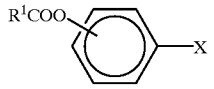

(III)

wherein $R^1$ represents a $C_{1-15}$ linear or branched alkyl group and X represents COOM or $SO_3M$, M being a hydrogen atom, an alkali metal atom or an alkaline earth metal atom.

In the bleach-activating agent represented by formula (III), it is preferable that $R^1$ is a $C_{7-11}$ linear or branched alkyl group and X is COOH or $SO_3Na$. Such bleach-activating agents include sodium lauroyloxybenzene sulfonate, sodium decanoyloxybenzene sulfonate, sodium octanoyloxybenzene sulfonate, lauroyloxybenzoic acid, decanoyloxybenzoic acid, octanoyloxybenzoic acid etc.

Other conventionally used detergent additives, for example, polymers such as polyethylene glycol and carboxymethyl cellulose, color migration-preventing agents such as polyvinyl pyrrolidone, enzymes such as protease, cellulase and lipase, enzyme stabilizers such as calcium chloride, formic acid and boric acid, defoaming agents such as silicone, antioxidants such as butyl hydroxy toluene, distyranated cresol, sodium sulfite and sodium hydrogen sulfite, perfumes, dyes, fluorescent dyes, pigments etc. may be contained as necessary.

Production Process

The liquid detergent composition of the present invention can be produced by process 1, preferably consisting of steps 1, 2 and 3, including the step of wet grinding the components (b) and (c) in the phase (a) to prepare a slurry of finely pulverized solid components, or by process 2, preferably consisting of steps 1, 2, 3 and 4, including the step of wet grinding the component (c) in the phase (a) to prepare a slurry of finely pulverized solid component, followed by adding the component (b)

Process 1

In step 1, the surfactant as the phase (a) and as necessary a water-soluble organic solvent and deionized water are mixed and the component (b) is dissolved or uniformly dispersed therein (referred to hereinafter as dispersion medium (1)). In this step, the mixture can also be heated at a suitable temperature, for example at 50 to 60° C. A bleach-activating agent, a peroxide-type bleacher component, an enzyme, a brightening agent, a perfume etc. are added preferably in step 3 described below.

In step 2, the component (c) and a mixture of other solid components to be ground are wet ground in the dispersion medium (1). The component (c), upon being finely pulverized, increases the surface area thereof to increase the rate of calcium exchange, thus acting as a further excellent washing builder. It is however known that the component (c) is then liable to gradual chemical change attributable to vapor and carbon dioxide in air to deteriorate the calcium exchange ability, and this phenomenon is enhanced by an increase in the surface area, thus making it difficult to incorporate the finely pulverized crystalline silicate compound or aluminosilicate compound into a powdery detergent etc. Japanese Patent No. 2958506 discloses a process for producing a particulate solid builder, which comprises wet grinding a solid builder such as a crystalline silicate compound and an aluminosilicate compound in a dispersion medium containing a surfactant, according to which, finely pulverized, excellent crystalline silicate and aluminosilicate compounds having a high calcium exchange ability can be obtained.

Preferable examples of the surfactant, the water-soluble organic solvent and the solid builder, such as inorganic and organic builders other than the crystalline silicate compound and aluminosilicate compound of the present liquid detergent composition are those described above. Solid components other than the solid builder in the present composition are also be finely pulverized in an analogous manner. When liquid phase-insoluble bleach-activating agent, other than the solid builder, is incorporated, it may be wet grouond together with the other solid components, added in the wet grinding step or incorporated in step 3.

The means of wet grinding includes a stone mill, a colloid mill, a KD mill, a slasher mill, a high-speed disperser, a media mill, a roll mill, a kneader, an extruder, a grinder with a liquid jet interaction chamber (e.g., a micro-flydizer manufactured by Microflydex Co., Ltd.), an ultrasonic dispersing instrument etc., and in particular, wet grinding using media, for example a method of using a sand mill, a sand grinder, a wet vibration mill, an attritor etc. is preferable in respect of the efficiency of grinding. As the media, known materials such as titania and zirconia can be used.

The media having a diameter of 0.1 to 1.0 mm are particularly suitable for grinding with a sand mill. When the particle size of the solid builder as a starting material is particularly large, the solid builder may be ground effectively by previously dry-grinding it until the particle size is reduced to a suitable size for wet grinding, for example 2 to 300 $\mu$m, or by grinding it by media having a larger diameter, for example a diameter of 2 mm and then grinding it by media with a smaller diameter.

To improve the efficiency of wet grinding the solid components, grinding is conducted preferably such that the ratio by weight of [the component (c) and a mixture with other solid components (or approximately the component (c)]/[the dispersion medium (1) (or approximately the component (a)] is from 30/70 to 60/40.

To improve the efficiency of wet grinding the solid components, the total volume of [the component (c) and a mixture with other solid components (or approximately the component (c)] and [the dispersion medium (1) (or approximately the component (a)] is preferably 0.9 to 1.1 times, more preferably 0.95 to 1.05 times as much as the volume of gaps of media introduced into a media mill such as sand mill, sand grinder, wet vibration mill and attritor. The term, the volume of 1.0 time as much as the volume of gaps of media refers to the volume of deionized water which has been introduced quietly at 20° C. into media until it reached the top of the media packed densely under vibration in advance.

Wet grinding is continued preferably 3 minutes or more, more preferably 5 minutes or more, until the average particle diameter of the solid components does not change.

To keep the viscosity low in the system and to improve the efficiency of grinding, the component(s) of the phase (a) can be added in divided portions. The component(s) of the phase (a) added in this step may be different from those of the step 1. Depending on the volume of the component added, the media are also added preferably so as to maintain the above shown ratio of the total volume to the volume of gaps of the media.

The average particle diameter of the resulting slurry of the finely pulverized solid components is preferably 500 $\mu$m or less, preferably 0.1 to 20 $\mu$m, more preferably 0.1 to 2 $\mu$m, and particularly preferably 0.1 to 1.0 $\mu$m.

Depending on the case, components of the phase (a) may be further added so as to attain a desired compounding ratio. After they have been mixed, the media may be removed, or after the other components have been added in step 3, the media may be removed.

In step 3, solid components preferably, not subjected to wet grinding in step 2, and other arbitrary components being soluble in the liquid are mixed and compounded therewith. The particle size of the solid components, preferably not subjected to wet grinding instep 2, may previously have been reduced under gentle conditions.

Process 2

In step 1, a surfactant and as necessary a water-soluble organic solvent and deionized water are mixed to form the phase (a). A bleach-activating agent, a peroxide type bleacher component, an enzyme, a brightening agent, a perfume etc. are added preferably in step 4 described later.

In step 2, the component (c) and a mixture of other solid components to be ground are wet ground in the phase (a) The component (c), upon being finely pulverized, increases the surface area thereof to increase the rate of calcium exchange, thus acting as a further excellent washing builder. It is however known that the component (c) is then liable to gradual chemical change attributable to vapor and carbon dioxide in air to deteriorate the calcium exchange ability, and this phenomenon is enhanced by an increase in the surface area, thus making it difficult to incorporate the finely pulverized crystalline silicate compound or aluminosilicate compound into a powdery detergent etc. Japanese Patent No. 2958506 discloses a process for producing a particulate solid builder which comprises wet grinding a solid builder such as a crystalline silicate compound and an aluminosilicate compound in a dispersion medium containing a surfactant, and according to this process, finely pulverized, excellent crystalline silicate and aluminosilicate compounds having a high calcium exchange ability can be obtained. Preferable examples of the surfactant, the water-soluble organic solvent and the solid builder (e.g. inorganic and organic builders besides the crystalline silicate compound and aluminosilicate compound) in the present liquid detergent composition are those described above, and solid components other than the solid builder in the present composition are also be finely pulverized in an analogous manner. When the liquid phase-insoluble bleach-activating agent among the solid components other than the solid builder is compounded, it may be wet ground together with the other solid components, may be added and ground during wet grinding, or may be compounded in step 4.

As the wet grinding, wet grinding particularly using media, for example, a method of using a sand mill, a sand grinder, a wet vibration mill, an attritor etc. is suitable for the efficiency of grinding. As the media, known materials such as titania and zirconia can be used.

The media having a diameter of 0.1 to 1.0 mm are particularly suitable for grinding with a sand mill. When the particle size of the solid builder as a starting material is particularly large, the solid builder may be ground effectively by previously dry-grinding it until the particle size is reduced to a suitable size for wet grinding, for example 80 to 300 $\mu$m, or by grinding it by media having a larger diameter, for example a diameter of 2 mm and then grinding it by media with a smaller diameter.

To improve the efficiency of wet grinding the solid components, the total volume of [the component (a), the component (c), and a mixture with other solid components (or approximately the component (c) only)] is preferably 0.9- to 1.1 times, more preferably 0.95- to 1.05 times as much as the volume of gaps of media introduced into a media mill (sand mill, sand grinder, wet vibration mill, attritor etc.). The term the volume of 1.0 time as much as the volume of gaps of media refers to the volume of deionized water which has been introduced quietly at 20° C. into media until it reached the top of the media packed in advance densely under vibration.

To improve the efficiency of wet grinding the solid components, grinding is conducted preferably such that the ratio by weight of [the component (c) and a mixture with other solid components (or approximately the component (c)]/[the phase (a)] is from 30/70 to 60/40.

Wet grinding is continued preferably 3 minutes or more, more preferably 5 minutes or more, until the average particle diameter of the solid components does not change.

To keep the viscosity low in the system and to improve the efficiency of grinding, the component in the phase (a) can be added in divided portions. The component in the phase (a) added in this step may be different from the component in the dispersion medium obtained in step 1. Depending on the volume of the component added, the media are also added preferably so as to keep the ratio of the above total volume to the volume of the gaps of the media.

The average particle diameter of the resulting slurry of the finely pulverized solid components is preferably 500 $\mu$m or less, preferably 0.1 to 20 $\mu$m, more preferably 0.1 to 2 $\mu$m, and particularly preferably 0.1 to 1.0 $\mu$m.

In step 3, the component (b) is dissolved or uniformly dispersed in the phase (a) in another tank to which a surfactant and as necessary a water-soluble organic solvent and deionized water were added. The component in the phase (a) used in this step may be different from the component in the dispersion medium in step 1.

The phase (a) containing the component (b) is added to and mixed with the slurry of the finely divided solid components obtained in step 2. At the time of compounding the component (b), the mixture can also be heated at a suitable temperature, for example 50 to 60° C. Thereafter, a part of the phase (a) maybe further added so as to attain a desired compounding ratio. After they are mixed, the media may be removed, or after the other components are added and mixed in step 4, the media may be removed.

In step 4, solid components preferably not subjected to wet grinding in step 2 and other arbitrary components soluble in the liquid are mixed and compounded therewith. The particle size of the solid components preferably not subjected to wet grinding in step 2 may previously have been reduced under gentle conditions.

The liquid detergent composition of the present invention can be produced in either process 1 or 2, but process 2 is more preferable because the component (c) can be easily finely pulverized and better stability can be achieved.

Further, when solid components previously sufficiently pulverized by dry-grinding etc. are used, a dispersing instrument such as a flow jet mixer or the like can be used to easily prepare the liquid detergent composition.

For improving the dispersion stability of particles and preventing scattering of the liquid during use, the viscosity of the present liquid detergent composition is preferably about 10 to 5000 mPa.s, more preferably 100 to 3000 mPa.s. The viscosity was determined at 25° C. by measuring 200 g of this composition in 200 ml beaker by No. 2 rotor under the rate condition of 30 rpm in a Brookfield type viscometer manufactured by Tokyo Keiki Co., Ltd.

The liquid detergent composition of the present invention comprises fine solid particles including those of a crystalline silicate compound and/or an aluminosilicate compound dispersed stably by a polymeric dispersant in a surfactant-containing liquid without increasing the viscosity of the product, and can be easily introduced into a laundering tank and rapidly dissolved in washing water. Further, the polymeric dispersant having a high cation exchange ability can act as a builder in washing water, to compact the detergent composition and to exhibit excellent detergency.

EXAMPLE

Synthesis Example 1

Example of Synthesis of Polymeric Dispersant (2) [N,N-dimethyl Acrylamide/Sodium 2-Acrylamide-2-methyl Propane Sulfonic Acid (Molar Ratio 80/20) random Copolymer]

95 g N,N-dimethyl acrylamide and 55 g sodium 2-acrylamide-2-methyl propane sulfonate were dissolved in 400 g deionized water and stirred for 10 minutes in nitrogen atmosphere. 1.6 g of 2,2'-azobis-(2-amidinopropane) dihydrochloride (V-50, produced by Wako Pure Chemical Industries, Ltd.) was added to this mixture, heated in nitrogen atmosphere and stirred for 6 hours at a temperature kept at 65 to 70° C. Thereafter, the reaction solution was returned to room temperature, and this aqueous solution was lyophilized to give a polymeric dispersant (2). As a result of measurement of the resulting dispersant by GPC, the weight average molecular weight was 222,000 (determined using polyethylene glycol standards). The conditions for GPC measurement were as follows: columns, 2 TSK GMP WXL columns produced by Tosoh Corporation; eluent, 0.2 M phosphate buffer/acetonitrile=9/1; detector, differential refractometer; and temperature, 40° C.

0.1 g of the polymeric dispersant (2) was accurately weighed and then dissolved in 100 ml of 0.1 M $NH_4Cl$—

$NH_4OH$ buffer, pH 10, and the solution was kept at 25° C. and titrated with a calcium ion solution containing 20,000 ppm $CaCO_3$ at pH 10 while the potential was measured. The concentration of calcium ion remaining in the solution was estimated from the relationship between the volume of the dropwise added solution and the potential and from a calibration curve prepared by measuring the relationship between calcium chloride solutions of known concentration and their potentials, and the amount of calcium ion captured by the polymeric dispersant (2) (i.e., the cation exchange capacity) as calculated therefrom was 23 $CaCO_3$ mg/g. For measurement of the potential, a 920A ion meter and a 9320 type electrode as a calcium electrode (Orion Co., Ltd.) were used.

Synthesis Example 2

Example of Synthesis of Polymeric Dispersant (3) [Polyethylene Glycol-Block-Polyacrylic Acid (Weight Ratio 40/60)]

40 g of poly[polyoxyethylene 4,4'-azobis(4-cyanopentanoate)] (VPE-0201, produced by Wako Pure Chemical Industries, Ltd.) and 60 g of acrylic acid were dissolved in 300 g deionized water, stirred for 10 minutes in nitrogen atmosphere, then heated, and stirred for 6 hours at a temperature kept at 65 to 70° C. The solution was neutralized under cooling on ice by gradually adding 110 ml of 6 N aqueous sodium hydroxide, whereby about 80% of the carboxyl groups of this polymer were converted into sodium salts. This aqueous solution was lyophilized to give a polymeric dispersant (3). As a result of measurement of the resulting dispersant by GPC, the weight average molecular weight was 78,000 (determined using polyethylene glycol standards). The conditions for GPC measurement were the same as in Synthesis Example 1. The cation exchange capacity of the polymeric dispersant (3), as calculated in the same manner as in Synthesis Example 1, was 157 $CaCO_3$ mg/g.

Synthesis Example 3

Example of Synthesis of Polymeric Dispersant (4) (Polyethylene Glycol-Graft-Poly(acrylic Acid/Maleic Acid [Molar Ratio 70/30]) (Weight Ratio 50/50))

50 g of polyethylene glycol (polyethylene glycol 2,000, produced by Wako Pure Chemical Industries, Ltd.) and 20.4 g of maleic acid were melted by heating in nitrogen atmosphere and further heated to 150° C. under stirring. 29.6 g acrylic acid and 4.3 g di-t-butyl peroxide were separately added dropwisely thereto over the period of 1 hour at a temperature kept at 145 to 150° C., and the mixture was further stirred for 3 hours at a temperature kept at 150° C. and returned to room temperature. The solution was diluted with 200 ml deionized water and neutralized under cooling on ice by gradually adding 100 ml of 6 N aqueous sodium hydroxide, whereby about 80% of the carboxyl groups of this polymer were converted into sodium salts. This aqueous solution was lyophilized to give a polymeric dispersant (4). As a result of measurement of the resulting dispersant by GPC, the weight average molecular weight was 45,000 (determined using polyethylene glycol standards). The conditions for GPC measurement were the same as in Synthesis Example 1. The cation exchange capacity of the polymeric dispersant (4), as calculated in the same manner as in Synthesis Example 1, was 190 $CaCO_3$ mg/g.

Synthesis Example 4

Example of Synthesis of Polymeric Dispersant (5) Poly(N,N-dimethyl Acrylamide/Styrene [Molar Ratio 90/10])-Graft-Poly(diallyl Dimethyl Ammonium Chloride) (Weight Ratio 50/50))

89.5 g of N,N-dimethyl acrylamide and 10.5 g of styrene were dissolved in 1 L acetone and stirred for 10 minutes in nitrogen atmosphere. 3.9 g of 2,2'-azobis-(2-methylbutyronitrile) (V-59, produced by Wako Pure Chemical Industries, Ltd.) was added thereto, heated in nitrogen atmosphere and stirred for 6 hours while the acetone was refluxed. Thereafter, the solution was returned to room temperature and purified by re-precipitation from 8 L hexane, the polymer separated by filtration was dissolved in 600 ml deionized water, and the hexane was distilled away by a rotary evaporator, whereby an aqueous solution of poly(N,N-dimethyl acrylamide/styrene) was obtained. As a result of measurement of the resulting dispersant by GPC, the weight average molecular weight was 22,000 (determined using polyethylene glycol standards). The conditions for GPC measurement were as follows: columns, 2 TSK GMHHR-H columns produced by Tosoh Corporation; eluent, 1 mM dimethyl lauryl amine/chloroform; detector, differential refractometer; and temperature, 40° C.

500 g of the resulting aqueous solution of poly(N,N-dimethyl acrylamide/styrene) (71.4 g polymer) was heated to 80° C. in nitrogen atmosphere. 119 g of 60% aqueous diallyl dimethyl ammonium chloride (Tokyo Kasei Co., Ltd.), and 5.3 g sodium persulfate dissolved in 60 ml deionized water, were separately added dropwise thereto over the period of 2 hours at a temperature kept at 80 to 85° C., and thereafter the mixture was further stirred for 6 hours at a temperature kept at 85° C. Thereafter, the reaction solution was returned to room temperature, and this aqueous solution was lyophilized to give a polymeric dispersant (5). As a result of measurement of the resulting dispersant by GPC, the weight average molecular weight was 39,000 (determined using polyethylene glycol standards) The conditions for GPC measurement were as follows: columns, 2 TSK $^{\alpha}$-M columns produced by Tosoh Corporation; eluent, 0.15 M sodium sulfate/1% aqueous acetic acid; detector, differential refractometer; and temperature, 40° C. The cation exchange capacity of the polymeric dispersant (5), as calculated in the same manner as in Synthesis Example 1, was 8 $CaCO_3$ mg/g.

Synthesis Example 5

Example of Synthesis of Polymeric Dispersant (6) [Polyethylene Glycol (Average Number of Moles of EO Added: 9) Monomethacrylate/Methacrylic Acid (Weight Ratio 50/50) Copolymer]

50 g polyethylene glycol (average number of moles of EO added: 9) monomethacrylate (NK ester M-90G, produced by Shin-Nakamura Chemical Co., Ltd.) and 50 g methacrylic acid were dissolved in 200 g ethanol and stirred for 10 minutes in nitrogen atmosphere. 11 g of 2,2'-azobis-(2,4-dimethylvaleronitrile) (V-65, produced by Wako Pure Chemical Industries, Ltd.) was added thereto, heated in nitrogen atmosphere, and stirred for 6 hours at a temperature kept at 75 to 80° C. Thereafter, the reaction solution was returned to room temperature, purified by re-precipitation from hexane and dried to give a polymeric dispersant (6). As a result of measurement of the resulting dispersant by GPC, the weight average molecular weight was 40,000 (determined using polyethylene glycol standards). The conditions for GPC measurement were the same as in Synthesis Example 1. The cation exchange capacity of the polymeric dispersant (6), as calculated in the same manner as in Synthesis Example 1, was 125 $CaCO_3$ mg/g.

Synthesis Example 6

Example of Synthesis of Polymeric Dispersant (7) [Polyethylene Glycol (Average Number of Moles of EO Added: 9) Monomethacrylate/Acrylic Acid (Weight Ratio 20/80) Copolymer]

20 g polyethylene glycol (average number of moles of EO added: 9) monomethacrylate (NK-ester M-90G, produced by Shin-Nakamura Chemical Co., Ltd.), 80 g acrylic acid dissolved in 80 g deionized water, and 1.6 g 2,2'-azobis-(2-methylpropionamidine)dihydrochloride (V-50, produced by Wako Pure Chemical Industries, Ltd.) dissolved in 80 g deionized water, while being kept at 60 to 65° C., were separately added dropwise over the period of 2 hours to 200 g deionized water previously heated to 60° C. in nitrogen atmosphere, and thereafter the mixture was stirred for 6 hours at a temperature kept at 65° C. The reaction solution was retuned to room temperature and neutralized under cooling on ice by gradually adding 150 ml of 6 N aqueous sodium hydroxide, whereby about 80% of the carboxyl groups of this polymer were converted into sodium salts. This aqueous solution was lyophilized to give a polymeric dispersant (7). As a result of measurement of the resulting dispersant by GPC, the weight average molecular weight was 49,000 (determined using polyethylene glycol standards). The conditions for GPC measurement were the same as in Synthesis Example 1. The cation exchange capacity of the polymeric dispersant (7), as calculated in the same manner as in Synthesis Example 1, was 168 $CaCO_3$ mg/g.

Synthesis Example 7

Example of Synthesis of Polymeric Dispersant (8) (Poly (acrylic Acid/Maleic Acid [Molar Ratio 90/10])-Graft-Poly (diallyl Dimethyl Ammonium Chloride) (Weight Ratio 70/30))

11 g maleic acid was dissolved in 200 g deionized water, and this solution was adjusted to pH 3.85 with 48% aqueous sodium hydroxide. The mixture was heated to 95° C. and kept at 95 to 98° C. in nitrogen atmosphere, and 64 g acrylic acid dissolved in 16 g deionized water, and 4.7 g sodium persulfate dissolved in 50 g deionized water, were separately added dropwise thereto over the period of 2 hours. Thereafter, the reaction solution was kept at 98° C., stirred for 6 hours, and retuned to room temperature to give an aqueous solution of poly(acrylic acid/maleic acid). As a result of measurement of the resulting dispersant by GPC, the weight average molecular weight was 87,000 (determined using polyethylene glycol standards). The conditions for GPC measurement were the same as in Synthesis Example 1.

300 g of the resulting aqueous solution of poly(acrylic acid/maleic acid) (64 g polymer) was heated to 65° C. in nitrogen atmosphere and kept at 65 to 70° C., and 46 g of 60% aqueous diallyl dimethyl ammonium chloride (Tokyo Kasei Co., Ltd.), and 2.0 g sodium persulfate dissolved in 40 g deionized water, were separately added dropwise thereto over the period of 2 hours. Thereafter, the mixture was stirred for 6 hours at a temperature kept at 70° C. and returned to room temperature, and this aqueous solution was lyophilized to give a polymeric dispersant (8). As a result of measurement of the resulting dispersant by GPC, the weight average molecular weight was 149,000 (determined using polyethylene glycol standards). The conditions for GPC measurement were the same as in Synthesis Example 4. The cation exchange capacity of the polymeric dispersant (8), as calculated in the same manner as in Synthesis Example 1, was 224 $CaCO_3$ mg/g.

Synthesis Example 8

Example of Synthesis of Polymeric Dispersant (9) (Sodium Polystyrene Sulfonate-Graft-Poly(acrylic Acid/Maleic Acid [Molar Ratio 60/40]) (Weight Ratio 50/50))

50 g maleic acid was dissolved in 480 g aqueous sodium polystyrene sulfonate (PS-35, 96 g polymer, produced by Tosoh Corporation), and this aqueous solution was adjusted to pH 3.85 with 40% aqueous sodium hydroxide. The mixture was heated to 95° C. and kept at 95 to 98° C. in nitrogen atmosphere, and 46 g acrylic acid dissolved in 12 g deionized water, and 12.7 g sodium persulfate dissolved in 80 g deionized water, were separately added dropwise thereto over the period of 2 hours, and thereafter, the solution was stirred for 6 hours at a temperature kept at 98° C. Thereafter, the reaction solution was retuned to room temperature and neutralized under cooling on ice by gradually adding 200 ml of 6 N aqueous sodium hydroxide, whereby about 80% of the carboxyl groups of this polymer were converted into sodium salts. This aqueous solution was lyophilized to give a polymeric dispersant (9). As a result of measurement of the resulting dispersant by GPC, the weight average molecular weight was 277,000 (determined using polyethylene glycol standards). The conditions for GPC measurement were the same as in Synthesis Example 1. The cation exchange capacity of the polymeric dispersant (9), as calculated in the same manner as in Synthesis Example 1, was 191 $CaCO_3$ mg/g.

Synthesis Example 9

Example of Synthesis of Polymeric Dispersant (10) [N,N-dimethyl Acrylamide/Acrylic Acid (Weight Ratio 50/50) Copolymer]

50 g N,N-dimethyl acrylamide and 50 g acrylic acid were dissolved in 250 g deionized water, and this aqueous solution was adjusted to pH 6.5 to 7 under cooling on ice by gradually adding 115 ml of 6 N aqueous sodium hydroxide. After the solution was stirred for 10 minutes in nitrogen atmosphere, 1.6 g of 2,2'-azobis-(2-amidinopropane) dihydrochloride (V-50, produced by Wako Pure Chemical Industries, Ltd.) was added thereto and heated in nitrogen atmosphere, and the mixture was stirred for 6 hours at a temperature kept at 65 to 70° C. Thereafter, the reaction solution was retuned to room temperature and lyophilized to give a polymeric dispersant (10). As a result of measurement of the resulting dispersant by GPC, the weight average molecular weight was 187,000 (determined using polyethylene glycol standards). The conditions for GPC measurement were the same as in Synthesis Example 1. The cation exchange capacity of the polymeric dispersant (10), as calculated in the same manner as in Synthesis Example 1, was 128 $CaCO_3$ mg/g.

Synthesis Example 10

Example of Synthesis of Polymeric Dispersant (11) [Polyethylene Glycol (Average Number of Moles of EO Added: 9) Monomethacrylate/Sodium Styrene Sulfonate (Weight Ratio 20/80) Copolymer]

20 g polyethylene glycol (average number of moles of EO added: 9) monomethacrylate (NK-ester M-90G, produced by Shin-Nakamura Chemical Co., Ltd.), 80 g sodium styrene sulfonate dissolved in 350 g deionized water, and 1.2 g of 2,2'-azobis-(2-methylpropionamidine)dihydrochloride (V-50, produced by Wako Pure Chemical Industries, Ltd.) dissolved in 100 g deionized water, while being kept at 60 to 65° C., were separately added dropwise over the period of 2 hours to 100 g deionized water previously heated to 60° C. in nitrogen atmosphere, then the mixture was further stirred for 6 hours at a temperature kept at 65° C., and the reaction solution was retuned to room temperature. This aqueous solution was lyophilized to give a polymeric dispersant (11). As a result of measurement of the resulting dispersant by GPC, the weight average molecular weight was 114,000 (determined using polyethylene glycol standards). The conditions for GPC measurement were the same as in Synthesis Example 1. The cation exchange capacity of the polymeric dispersant (11), as calculated in the same manner as in Synthesis Example 1, was 14 $CaCO_3$ mg/g.

Synthesis Example 11

Example of Synthesis of Polymeric Dispersant (12) [Polyethylene Glycol (Average Number of Moles of EO Added: 34) Mono-allyl Ether/Maleic Acid (Weight Ratio 20/80) Copolymer]

After 156.8 g maleic anhydride and 313.6 g polyethylene glycol (average number of moles of EO added: 34) mono-allyl ether were dissolved in 400 g deionized water, the flask temperature was increased to 70° C., and 60 g of 48% aqueous sodium hydroxide was added thereto. The atmosphere in the flask was exchanged with nitrogen, the mixture was heated to 98° C., then an aqueous initiator solution consisting of 42.8 g of 35% aqueous hydrogen peroxide and 4.77 g sodium persulfate was added dropwise thereto over the period of 6 hours, and the flask temperature was kept at 98° C. for 4 hours. This aqueous solution was lyophilized to give a polymeric dispersant (12). As a result of measurement of the resulting dispersant by GPC, the weight average molecular weight was 18,000 (determined using polyethylene glycol standards). The conditions for GPC measurement were the same as in Synthesis Example 1. The cation exchange capacity of the polymeric dispersant (12), as calculated in the same manner as in Synthesis Example 1, was 121 $CaCO_3$ mg/g.

Example 1

Step 1:

A mixture of 218 g of the nonionic surfactant (1) (Softanol 70, produced by Nippon Shokubai Co., Ltd.) and 73 g of 1,3-butanediol (Wako Pure Chemical Industries, Ltd.) was heated at 50° C., and 8.8 g polymeric dispersant (1) [a lyophilized product of Aquarock FC600S (40% aqueous solution of polyethylene glycol (average number of moles of EO added: 10) monomethacrylate/methacrylic acid (molar ratio 38/62) copolymer produced by Nippon Shokubai Co., Ltd.; cation exchange capacity, 26 $CaCO_3$ mg/g) was dissolved therein over the period of 5 hours.

Step 2:

33 g crystalline silicate compound (1) (SKS-6, layered sodium silicate with a particle diameter of 60 to 80 $\mu$m, produced by Hoechst) was suspended in 33 g of the liquid phase obtained in step 1 and then wet ground for 5 hours at a disk revolution of 1500 rpm in a sand mill (Imex Co., Ltd.) with a volume of 1 L charged with 500 g zirconia beads of 0.8 mm in diameter. At the time of wet grinding, the total volume of the liquid phase and the crystalline silicate compound (1) corresponded to the volume of the gaps of the zirconia beads introduced into the sand mill. Apart of the dispersion of the crystalline silicate compound obtained in this grinding operation was collected and diluted with the liquid produced in step 1, and the average particle size as determined by a particle size distribution measuring device (LA-910, manufactured by Horiba Ltd.) was 1.6 $\mu$m.

Further, 96 g of the liquid produced in step 1 was introduced into the above sand mill and mixed therewith for 15 minutes at a disk revolution of 1500 rpm, followed by removal of the media through a 40 mesh sieve to give a dispersion.

Step 3:

1.2 g of a bleach-activating agent represented by formula (IV):

(IV)

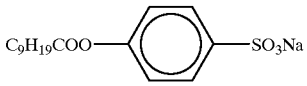

and a trace of perfume were added to the dispersion obtained in step 2 and dissolved by sufficient stirring at room temperature. Further, 1.65 g sodium percarbonate powder (average particle diameter of 16 $\mu$m as determined by LA-910 (Horiba, Ltd.) after it was dispersed in the liquid produced in step 1) was added thereto and dispersed by sufficient stirring at room temperature, to give a liquid detergent composition.

Examples 2 to 10

Using the components shown in Table 1, various liquid detergent compositions were produced in the same manner as in Example 1.

Comparative Examples 1 to 4

Using the components shown in Table 1, various liquid detergent compositions were produced in the same manner as in Example 1.

Example 11

Step 1:

A mixture of 82.5 g of the nonionic surfactant (2) (Emulgen 108, produced by Kao Corporation) and 49.5 g of the nonionic surfactant (3) (polyoxyethylene phenyl ether PHG-30, produced by Nippon Nyukazai Co., Ltd.) was prepared.

Step 2:

33 g crystalline silicate compound (2) (crystalline silicate compound described in Example 1 in JP-A 5-184946) was suspended in 33 g of the liquid component obtained in step 1 and wet ground for 3 hours at a disk revolution of 1500 rpm in a sand mill (Imex Co., Ltd.) with a volume of 1 L charged with 500 g zirconia beads of 0.8 mm in diameter. Then, 17 g of the liquid component obtained in step 1 and 142 g zirconia beads of 0.8 mm in diameter were introduced into it and further wet ground at a disk revolution of 1500 rpm for 2 hours. At the time of wet grinding, the total volume of the mixture of the crystalline silicate compound (2) and the liquid component corresponds to 1.0-fold relative to the volume of the gap among the zirconia beads of 0.8 mm in diameter.

A part of the dispersion of the crystalline silicate compound obtained in this grinding operation was collected and diluted with the liquid produced in step 1, and the average particle size as determined by a particle size distribution measuring device (LA-910, manufactured by Horiba, Ltd.) was 0.8 $\mu$m.

Step 3:

82 g of the liquid produced in step 1 was heated at 50° C., and 1.7 g of the polymeric dispersant (1) was dissolved therein over the period of 5 hours. The resulting liquid solution containing the polymeric dispersant was introduced to the above sand mill and mixed therewith for 2 hours at a disk revolution of 1500 rpm, followed by removal of the media through a 40 mesh sieve.

Step 4:

1.8 g of the bleach-activating agent represented by formula (IV) above and a trace of perfume were added to the dispersion obtained in step 3 and dissolved by sufficient stirring at room temperature. Further, 2.5 g sodium percarbonate powder (average particle diameter of 16 μm as determined by LA-910 (Horiba, Ltd.) after it was dispersed in the liquid produced in step 1) was added thereto and dispersed therein by sufficient stirring at room temperature, to give a liquid detergent composition.

Example 12

Step 1:

A mixture of 77.7 g of the nonionic surfactant (2) and 23.3 g of the nonionic surfactant (3) was prepared.

Step 2:

33 g of the crystalline silicate compound (2) was suspended in 33 g of the liquid component obtained in step 1 and wet ground for 3 hours at a disk revolution of 1500 rpm in a sand mill (Imex Co., Ltd.) with a volume of 1 L charged with 500 g zirconia beads of 0.3 mm in diameter. Then, 34 g of the liquid component obtained in step 1 and 283 g zirconia beads of 0.3 mm in diameter were introduced into it and wet ground at a disk revolution of 1500 rpm for 2 hours. Further, 34 g of the liquid component obtained in step 1 and 283 g zirconia beads of 0.3 mm in diameter were introduced into it and wet ground at a disk revolution of 1500 rpm for 2 hours. At the time of wet grinding, the total volume of the mixture of the crystalline silicate compound (2) and the liquid component corresponds to 1.0-fold relative to the volume of the gaps of the zirconia beads of 0.3 mm in diameter.

A part of the dispersion of the crystalline silicate compound obtained in this grinding operation was collected and diluted with the liquid produced in step 1, and the average particle size as determined by a particle size distribution measuring device (LA-910, manufactured by Horiba, Ltd.) was 0.6 μm.

Step 3:

23.3 g of the nonionic surfactant (3) was heated at 50° C., and 1.7 g of the polymeric dispersant (6) was dissolved therein over the period of 5 hours. The resulting liquid solution containing the polymeric dispersant was introduced to the above sand mill and mixed therewith for 2 hours at a disk revolution of 1500 rpm, followed by removal of the media through a 40 mesh sieve.

Step 4:

A trace of perfume was added to the dispersion obtained in step 3 and dissolved by sufficient stirring at room temperature. Further, 2.5 g sodium percarbonate powder (average particle diameter of 16 μm as determined by LA-910 (Horiba, Ltd.) after it was dispersed in the liquid produced in step 1) was added thereto and dispersed therein by sufficient stirring at room temperature, to give a liquid detergent composition.

Example 13

Step 1:

A mixture of 31.25 g of the nonionic surfactant (2) and 18.75 g of the nonionic surfactant (3) was prepared.

Step 2:

33 g of the crystalline silicate compound (2) was suspended in 33 g of the liquid component obtained in step 1 and wet ground for 3 hours at a disk revolution of 1500 rpm in a sand mill (Imex Co., Ltd.) with a volume of 1 L charged with 500 g zirconia beads of 0.8 mm in diameter. Then, 17 g of the liquid component obtained in step 1 and 142 g zirconia beads of 0.8 mm in diameter were introduced into it and wet ground at a disk revolution of 1500 rpm for 2 hours. At the time of wet grinding, the total volume of the mixture of the crystalline silicate compound (2) and the liquid component corresponds to 1.0-fold relative to the volume of the gaps of the zirconia beads of 0.8 mm in diameter.

A part of the dispersion of the crystalline silicate compound obtained in this grinding operation was collected and diluted with the liquid produced in step 1, and the average particle size as determined by a particle size distribution measuring device (LA-910, manufactured by Horiba, Ltd.) was 0.7 μm.

Step 3:

31 g of the nonionic surfactant (3) was heated at 50° C., and 1.7 g of the polymeric dispersant (1) was dissolved therein over the period of 5 hours. The resulting liquid solution containing the polymeric dispersant was introduced to the above sand mill and mixed therewith for 2 hours at a disk revolution of 1500 rpm, followed by removal of the media through a 40 mesh sieve.

Step 4:

1.8 g of the bleach-activating agent represented by formula (IV) above and a trace of perfume were added to the dispersion obtained in step 3 and dissolved by sufficient stirring at room temperature. Further, 8.3 g of zeolite (1) (Toyo builder (Tosoh Corporation) dehydrated by calcination at 450° C. for 1 hour) which had previously been wet ground to an average particle diameter of 0.7 μm in 51 g of the nonionic surfactant (2), and 2.5 g sodium percarbonate powder (average particle diameter of 16 μm as determined by LA-910 (Horiba, Ltd.) after it was dispersed in the liquid produced in step 1), were added thereto and dispersed therein by sufficient stirring at room temperature, to give a liquid detergent composition.

Example 14

Step 1:

29.9 g of the nonionic surfactant (3) was heated at 50° C., and 2.1 g of the polymeric surfactant (6) was dissolved therein over the period of 5 hours to give a polymeric dispersant solution. 48 g of the nonionic surfactant (2) was mixed with the above polymeric dispersant solution to prepare a liquid solution containing the polymeric dispersant.

Step 2:

20 g of the crystalline silicate compound (2) was suspended in 80 g of the liquid component obtained in step 1 and wet ground for 5 hours at a disk revolution of 1500 rpm in a batch sand mill (Imex Co., Ltd.) with a volume of 1 L charged with 670 g zirconia beads of 0.3 mm in diameter. In this case, the volume of the crystalline silicate compound (2) and the liquid component corresponds to 1.15-fold relative to the volume of the gaps of the media.

A part of the dispersion of the crystalline silicate compound obtained in this grinding operation was collected and diluted with the liquid produced in step 1 in Example 11, and the average particle size as determined by a particle size distribution measuring device (LA-910, manufactured by Horiba, Ltd.) was 3.4 μm.

Step 3:

The dispersion produced in step 2 was passed through a 40 mesh sieve to remove the media.

Step 4:

A trace of perfume was added to the dispersion obtained in step 3 and dissolved by sufficient stirring at room temperature. Further, 2.5 g sodium percarbonate powder (average particle diameter of 16 μm as determined by LA-910 (Horiba, Ltd.) after it was dispersed in the liquid produced in step 1) was added thereto and dispersed therein by sufficient stirring at room temperature, to give a liquid detergent composition.

Example 15

Step 1:

A mixture of 31.25 g of the nonionic surfactant (2) and 18.75 g of the nonionic surfactant (3) was prepared.

Step 2:

33 g of the crystalline silicate compound (2) was suspended in 50 g of the liquid component obtained in step 1 and wet ground for 5 hours at a disk revolution of 1500 rpm in a sand mill (Imex Co., Ltd.) with a volume of 1 L charged with 500 g zirconia beads of 0.8 mm in diameter. In this case, the volume of the crystalline silicate compound (2) and the liquid component corresponds to 1.18-fold relative to the volume of the gaps of the media.

A part of the dispersion of the crystalline silicate compound obtained in this grinding operation was collected and diluted with the liquid produced in step 1, and the average particle size as determined by a particle size distribution measuring device (LA-910, manufactured by Horiba, Ltd.) was 2.3 μm.

Step 3:

31 g of the nonionic surfactant (3) was heated at 50° C., and 1.7 g of the polymeric dispersant (1) was dissolved therein over the period of 5 hours. The resulting liquid solution containing the polymeric dispersant was introduced to the above sand mill and mixed therewith for 15 minutes at a disk revolution of 1500 rpm, followed by removal of the media through a 40 mesh sieve.

Step 4:

1.8 g of the bleach-activating agent represented by formula (IV) above and a trace of perfume were added to the dispersion obtained in step 3 and dissolved by sufficient stirring at room temperature. Further, 8.2 g zeolite (1) previously wet grouond in 51 g of the nonionic surfactant (2) and 2.5 g sodium percarbonate powder (average particle diameter of 16 μm as determined by LA-910 (Horiba, Ltd.) after it was dispersed in the liquid produced in step 1), were added thereto and dispersed therein by sufficient stirring at room temperature, to give a liquid detergent composition.

Example 16

Step 1:

A mixture of 204 g nonionic surfactant (1) (Softanol 70, produced by Nippon Shokubai Co., Ltd.) and 80 g 1,3-butanediol (Wako Pure Chemical Industries, Ltd.) was heated at 50° C., and 16.4 g of the polymeric dispersant (7) obtained in Synthesis Example 6 was dissolved therein over the period of 5 hours.

Step 2:

50 g of Toyo builder (produced by Tosoh Corporation) which had previously been dehydrated by calcination at 450° C. for 1 hour was suspended in 50 g of the liquid phase obtained in step 1 and wet ground for 5 hours at a disk revolution of 1500 rpm in a sand mill (Imex Co., Ltd.) with a volume of 1 L charged with 400 g zirconia beads of 0.8 mm in diameter.

A part of the dispersion of the crystalline silicate compound obtained in this grinding operation was collected and diluted with the liquid produced in step 1, and the average particle size as determined by a particle size distribution measuring device (LA-910, manufactured by Horiba, Ltd.) was 0.8 μm.

Further, 146 g of the liquid obtained in step 1 was introduced into the above sand mill and mixed therewith for 15 minutes at a disk revolution of 1500 rpm, followed by removal of the media through a 40 mesh sieve to give a dispersion.

Step 3:

1.8 g of the bleach-activating agent represented by formula (IV) and a trace of perfume were added to the dispersion obtained in step 2 and dissolved by sufficient stirring at room temperature. Further, 2.5 g sodium percarbonate powder (average particle diameter of 16 μm as determined by LA-910 (Horiba, Ltd.) after it was dispersed in the liquid produced in step 1) was added thereto and dispersed therein by sufficient stirring at room temperature, to give a liquid detergent composition.

Examples 17 to 27

Using the components shown in Table 3, various liquid detergent compositions were produced in the same manner as in Example 16.

Comparative Examples 5 to 9

Using the components shown in Table 3, various liquid detergent compositions were produced in the same manner as in Example 16.

The liquid detergent compositions obtained in Examples 1 to 27 and Comparative Examples 1 to 9 were measured for their degrees of separation by volume in the following method and examined in a washing test. The results are shown in Tables 1, 2 and 3.

(1) The Degree of Separation by Volume

A scaled glass sedimentation tube was charged with a liquid detergent composition to a depth of 30 cm and then sealed, and each sample was stored for 1 month indoors at a room temperature (25° C.). After storage, the boundary between the transparent liquid phase and the solid-dispersed phase in each sample was judged visually, and the thickness x (cm) of the transparent liquid phase occurring as the upper layer by phase separation was measured. The degree of separation by volume, y, was determined according to the following equation (V)

$$y=(x/30)\times 100 \quad \text{(V)}$$

(2) Washing Test 100 g of a mixture consisting of 15% carbon black, 60% cottonseed oil, 5% cholesterol, 5% oleic acid, 5% palmitic acid and 10% liquid paraffin was dissolved and suspended in 8 L parklen, and a cut cotton white cloth of 10 cm×10 cm in size (purse net 2003 cloth) was stained by impregnated therewith followed by removing the parklen by drying to prepare a sebum/carbon-stained cloth (artificially stained cloth).

Each group consisting of five sebum/carbon-stained clothes was placed in 1 L aqueous detergent solution to be evaluated, and then examined by a tagotometer under the following conditions:

Washing time: 10 min.

Detergent composition: 0.8 g/L aqueous detergent solution evaluated.

Water hardness: 71.2 mg $CaCO_3$/L.
Water temperature: 20° C.
Number of revolutions of the tagotometer: 100 rpm.
Rinsing: Rinsing for 5 min. with running tap water at 20° C.

The detergency was determined by measuring the reflectance at 550 nm of the original cloth before staining and the stained cloth before and after washing by means of a recording colorimeter (Shimadzu Corporation) and then determining the degree of washing (%) by the following equation.

Degree of washing(%)={(reflectance after washing−reflectance before washing)}/(reflectance of the original cloth−reflectance before washing)}×100

TABLE 1

| | | | Examples | | | | |
|---|---|---|---|---|---|---|---|
| | | | 1 | 2 | 3 | 4 | 5 |
| Components (wt %) | Step 1 | Nonionic surfactant (1)*1 | 57 | 57 | 74 | 74 | 74 |
| | | Anionic surfactant *4 | | | | | |
| | | Water-soluble organic solvent *5 | 19 | 19 | | | |
| | | Polymeric dispersant (1) *6 (cation exchange capacity 26$CaCO_3$ mg/g) | 2.3 | 2.3 | | | |
| | | Polymeric dispersant (2) *7 (cation exchange capacity 23$CaCO_3$ mg/g) | | | 2.3 | | |
| | | Polymeric dispersant (3) *8 (cation exchange capacity 157$CaCO_3$ mg/g) | | | | 2.3 | |
| | | Polymeric dispersant (4) *9 (cation exchange capacity 190$CaCO_3$ mg/g) | | | | | 2.3 |
| | | Polymeric dispersant (5) *10 (cation exchange capacity 8$CaCO_3$ mg/g) | | | | | |
| | | Polymeric dispersant (11) *16 (cation exchange capacity 14$CaCO_3$ mg/g) | | | | | |
| | | Polymer (1) *18 | | | | | |
| | | Polymer (2) *19 | | | | | |
| | | Bleach-activating agent *22 | | 0.7 | | | |
| | Step 2 | Crystalline silicate compound (1) *23 | 20 | 20 | | | |
| | | Crystalline silicate compound (1) *24 | | | 10 | 10 | 10 |
| | | Zeolite (1) *25 | | | 5 | 5 | 5 |
| | | Zeolite (2) *26 | | | | | |
| | | Sodium carbonate | | | 3 | 3 | 3 |
| | | Sodium citrate | | | 2 | 2 | 2 |
| | Step 3 | Sodium percarbonate | 1 | 1 | 1 | 1 | 1 |
| | | Bleach-activating agent *22 | 0.7 | | 0.7 | 0.7 | 0.7 |
| | | Ebalase 16. OL-EX *27 | | | 1 | 1 | 1 |
| | | Lipolase 1OOL *28 | | | 1 | 1 | 1 |
| | | Perfume | trace amount | ← | ← | ← | ← |
| Evaluation results | | The degree of separation by volume after 1 month (%) | 1 | 3 | 4 | 2 | 1 |
| | | Degree of washing (%) | 78 | 76 | 80 | 80 | 81 |

| | | | Examples | | | | |
|---|---|---|---|---|---|---|---|
| | | | 6 | 7 | 8 | 9 | 10 |
| Components (wt %) | Step 1 | Nonionic surfactant (1)*1 | 74 | 74 | 56 | 58.3 | 67 |
| | | Anionic surfactant *4 | | | 3 | | |
| | | Water-soluble organic solvent *5 | | | 17 | 19.4 | |
| | | Polymeric dispersant (1) *6 (cation exchange capacity 26$CaCO_3$ mg/g) | | | 2.3 | 2.3 | |
| | | Polymeric dispersant (2) *7 (cation exchange capacity 23$CaCO_3$ mg/g) | | | | | |
| | | Polymeric dispersant (3) *8 (cation exchange capacity 157$CaCO_3$ mg/g) | | | | | 3.3 |
| | | Polymeric dispersant (4) *9 (cation exchange capacity 190$CaCO_3$ mg/g) | 2.3 | | | | |
| | | Polymeric dispersant (5) *10 (cation exchange capacity 8$CaCO_3$ mg/g) | | 2.3 | | | |
| | | Polymeric dispersant (11) *16 (cation exchange capacity 14$CaCO_3$ mg/g) | | | | | |
| | | Polymer (1) *18 | | | | | |
| | | Polymer (2) *19 | | | | | |
| | | Bleach-activating agent *22 | | | | | |
| | Step 2 | Crystalline silicate compound (1) *23 | | | 20 | 20 | 28 |
| | | Crystalline silicate compound (1) *24 | 10 | 10 | | | |
| | | Zeolite (1) *25 | | 5 | | | |
| | | Zeolite (2) *26 | 5 | | | | |
| | | Sodium carbonate | 3 | 3 | | | |
| | | Sodium citrate | 2 | 2 | | | |

TABLE 1-continued

| | | | | | | | |
|---|---|---|---|---|---|---|---|
| | Step 3 | Sodium percarbonate | 1 | 1 | 1 | | 1 |
| | | Bleach-activating agent *22 | 0.7 | 0.7 | 0.7 | | 0.7 |
| | | Ebalase 16. OL-EX *27 | 1 | 1 | | | |
| | | Lipolase 1OOL *28 | 1 | 1 | | | |
| | | Perfume | trace amount | ← | ← | ← | ← |
| Evaluation results | | The degree of separation by volume after 1 month (%) | 3 | 1 | 2 | 1 | 3 |
| | | Degree of washing (%) | 79 | 78 | 79 | 76 | 81 |

| | | | Comparative Examples | | | |
|---|---|---|---|---|---|---|
| | | | 1 | 2 | 3 | 4 |
| Components (wt %) | Step 1 | Nonionic surfactant (1) *1 | 58.7 | 57 | 57 | 57 |
| | | Anionic surfactant *4 | | | | |
| | | Water-soluble organic solvent *5 | 19.6 | 19 | 19 | 19 |
| | | Polymeric dispersant (1) *6 (cation exchange capacity 26$CaCO_3$ mg/g) | | | | |
| | | Polymeric dispersant (2) *7 (cation exchange capacity 23$CaCO_3$ mg/g) | | | | |
| | | Polymeric dispersant (3) *8 (cation exchange capacity 157$CaCO_3$ mg/g) | | | | |
| | | Polymeric dispersant (4) *9 (cation exchange capacity 190$CaCO_3$ mg/g) | | | | |
| | | Polymeric dispersant (5) *10 (cation exchange capacity 8$CaCO_3$ mg/g) | | | | |
| | | Polymeric dispersant (11) *16 (cation exchange capacity 14$CaCO_3$ mg/g) | | | | 2.3 |
| | | Polymer (1)*18 | | 2.3 | | |
| | | Polymer (2)*19 | | | 2.3 | |
| | | Bleach-activating agent *22 | | | | |
| | Step 2 | Crystalline silicate compound (1) *23 | 20 | 20 | 20 | |
| | | Crystalline silicate compound (1) *24 | | | | |
| | | Zeolite (1)*25 | | | | 8 |
| | | Zeolite (2)*26 | | | | |
| | | Sodium carbonate | | | | 10 |
| | | Sodium citrate | | | | 2 |
| | Step 3 | Sodium percarbonate | 1 | 1 | 1 | 1 |
| | | Bleach-activating agent *22 | 0.7 | 0.7 | 0.7 | 0.7 |
| | | Ebalase 16. OL-EX *27 | | | | |
| | | Lipolase 100L *28 | | | | |
| | | Perfume | trace amount | ← | ← | ← |
| Evaluation results | | The degree of separation by volume after 1 month (%) | 87 | 57 | 53 | 3 |
| | | Degree of washing (%) | 78 | 77 | 78 | 66 |

TABLE 2

| | | | Examples | | | | |
|---|---|---|---|---|---|---|---|
| | | | 11 | 12 | 13 | 14 | 15 |
| Component (wt %) | Step 1 | Nonionic surfactant (2) *2 | 48.25 | 48.15 | 17.4 | 46.85 | 17.4 |
| | | Nonionic surfactant (3) *3 | 28.9 | 14.4 | 10.5 | 29.2 | 10.5 |
| | | Polymeric dispersant (6) *11 (cation exchange capacity 125 $CaCO_3$ mg/g) | | | | 2 | |
| | Step 2 | Crystalline silicate compound (2) *24 | 19.3 | 20.4 | 18.4 | 19.5 | 18.4 |
| | Step 3 | Nonionic surfactant (3) *3 | | 14.5 | 17.3 | | 17.3 |
| | | Polymeric dispersant (1) *6 (cation exchange capacity 26$CaCO_3$ mg/g) | 1.0 | | 0.95 | | 0.95 |
| | | Polymeric dispersant (6) *11 (cation exchange capacity 125$CaCO_3$ mg/g) | | 1.05 | | | |
| | Step 4 | Bleach-activating agent *22 | 1.05 | | 1.0 | | 1.0 |
| | | Nonionic surfactant (2) *2 | | | 28.5 | | 28.5 |
| | | Zeolite (1) *25 | | | 4.55 | | 4.55 |
| | | Sodium percarbonate | 1.5 | 1.5 | 1.4 | 2.45 | 1.4 |
| | | Perfume | trace amount | ← | ← | ← | ← |

TABLE 2-continued

| | | Examples | | | | |
|---|---|---|---|---|---|---|
| | | 11 | 12 | 13 | 14 | 15 |
| In wet-grinding, the ratio of the total volume of the phase (a) and the component (c) to the volume of gaps of media introduced into a media mill (times) | | 1.0 | 1.0 | 1.0 | 1.15 | 1.18 |
| Average diameter of the crystalline silicate compound in the disperse solution of step 2 ($\mu$m) | | 0.8 | 0.6 | 0.7 | 3.4 | 2.3 |
| Evaluation results | The degree of separation by volume after 1 month (%) | 1 | 0.5 | 0.8 | 5 | 5 |
| | Degree of washing (%) | 79 | 83 | 81 | 78 | 75 |

TABLE 3

| | | | Examples | | | | | |
|---|---|---|---|---|---|---|---|---|
| | | | 16 | 17 | 18 | 19 | 20 | 21 |
| Component (wt %) | Step 1 | Nonionic surfactant (1) *1 | 53 | 53 | 53 | 53 | 53 | 53 |
| | | Anionic surfactant *4 | | | | | | |
| | | Monoethanol | | | | | | |
| | | Water-soluble organic solvent *5 | 21 | 21 | 21 | 21 | 21 | 21 |
| | | Deionized water | | | | | | |
| | | Polymeric dispersant (7) *12 (cation exchange capacity 168$CaCO_3$ mg/g) | 4.3 | 4.3 | | | | |
| | | Polymeric dispersant (3) *8 (cation exchange capacity 157$CaCO_3$ mg/g) | | | 4.3 | | | |
| | | Polymeric dispersant (4) *9 (cation exchange capacity 190$CaCO_3$ mg/g) | | | | 4.3 | 4.3 | |
| | | Polymeric dispersant (8) *13 (cation exchange capacity 224$CaCO_3$ mg/g) | | | | | | 43 |
| | | Polymeric dispersant (9) *14 (cation exchange capacity 191$CaCO_3$ mg/g) | | | | | | |
| | | Polymeric dispersant (10) *15 (cation exchange capacity 128$CaCO_3$ mg/g) | | | | | | |
| | | Polymeric dispersant (11) *16 (cation exchange capacity 14$CaCO_3$ mg/g) | | | | | | |
| | | Polymeric dispersant (12) *17 (cation exchange capacity 121$CaCO_3$ mg/g) | | | | | | |
| | | Polymer (3) *20 | | | | | | |
| | | Polymer (4) *21 | | | | | | |
| | | Polymer (2) *19 | | | | | | |
| | Step 2 | Zeolite (1) *25 | 20 | 10 | 10 | 10 | | 10 |
| | | Zeolite (2) *26 | | | | | 10 | |
| | | Sodium carbonate | | 8 | 8 | 8 | 8 | 8 |
| | Step 3 | Sodium percarbonate | 1 | 1 | 1 | 1 | 1 | 1 |
| | | Bleach-activating agent *22 | 0.7 | 0.7 | 0.7 | 0.7 | 0.7 | 0.7 |
| | | Ebalase 16. OL-EX *27 | | 1 | 1 | 1 | 1 | 1 |
| | | Lipolase 1OOL *28 | | 1 | 1 | 1 | 1 | 1 |
| | | Perfume | trace amount | ← | ← | ← | ← | ← |
| Evaluation results | | The degree of separation by volume after 1 month (%) | 1 | 1 | 2 | 1 | 2 | 1 |
| | | Degree of washing (%) | 75 | 77 | 78 | 79 | 77 | 79 |

| | | | Examples | | | | | |
|---|---|---|---|---|---|---|---|---|
| | | | 22 | 23 | 24 | 25 | 26 | 27 |
| Component (wt %) | Step 1 | Nonionic surfactant (1)* 1 | 53 | 44 | 52 | 35 | 43 | 53 |
| | | Anionic surfactant *4 | | | 18 | 3 | | |
| | | Monoethanol | | | 4 | 5 | | |
| | | Water-soluble organic solvent *5 | 21 | 18 | | | | 21 |
| | | Deionized water | | | | 32 | 32 | |
| | | Polymeric dispersant (7) *12 (cation exchange capacity 168$CaCO_3$ mg/g) | | | | | | |
| | | Polymeric dispersant (3) *8 (cation exchange capacity 157$CaCO_3$ mg/g) | | | | | | |
| | | Polymeric dispersant (4) *9 (cation exchange capacity 190$CaCO_3$ mg/g) | | 4.3 | 4.3 | | | |
| | | Polymeric dispersant (8) *13 (cation exchange capacity 224$CaCO_3$ mg/g) | | | | | | |

TABLE 3-continued

| | | | | | | | | |
|---|---|---|---|---|---|---|---|---|
| | | Polymeric dispersant (9) *14 | | | | 5 | 5 | |
| | | (cation exchange capacity 191$CaCO_3$ mg/g) | | | | | | |
| | | Polymeric dispersant (10) *15 | 4.3 | | | | | |
| | | (cation exchange capacity 128$CaCO_3$ mg/g) | | | | | | |
| | | Polymeric dispersant (11) *16 | | | | | | |
| | | (cation exchange capacity 14$CaCO_3$ mg/g) | | | | | | |
| | | Polymeric dispersant (12) *17 | | | | | | 4.3 |
| | | (cation exchange capacity 121$CaCO_3$ mg/g) | | | | | | |
| | | Polymer (3) *20 | | | | | | |
| | | Polymer (4) *21 | | | | | | |
| | | Polymer (2) *19 | | | | | | |
| | Step 2 | Zeolite (1) *25 | 10 | 17 | 10 | | | |
| | | Zeolite (2) *26 | | | | 20 | 20 | 10 |
| | | Sodium carbonate | 8 | 13 | 8 | | | 8 |
| | Step 3 | Sodium percarbonate | 1 | 1 | 1 | | | 1 |
| | | Bleach-activating agent *22 | 0.7 | 0.7 | 0.7 | | | 0.7 |
| | | Ebalase 16. OL-EX *21 | 1 | 1 | 1 | | | 1 |
| | | Lipolase 100L *28 | 1 | 1 | 1 | | | 1 |
| | | Perfume | trace amount | ← | ← | ← | ← | ← |
| Evaluation results | | The degree of separation by volume after 1 month (%) | 4 | 2 | 2 | 2 | 2 | 1 |
| | | Degree of washing (%) | 77 | 80 | 76 | 77 | 78 | 80 |

| | | | Comparative Examples | | | | |
|---|---|---|---|---|---|---|---|
| | | | 5 | 6 | 7 | 8 | 9 |
| Component (wt %) | Step 1 | Nonionic surFactant (1)*1 | 53 | 53 | 53 | 35 | 35 |
| | | Anionic surfactant *4 | | | | 3 | 3 |
| | | Monoethanol | | | | 5 | 5 |
| | | Water-soluble organic solvent *5 | 21 | 21 | 21 | | |
| | | Deionized water | | | | 32 | 32 |
| | | Polymeric dispersant (7) *12 | | | | | |
| | | (cation exchange capacity 168$CaCO_3$ mg/g) | | | | | |
| | | Polymeric dispersant (3) *8 | | | | | |
| | | (cation exchange capacity 157$CaCO_3$ mg/g) | | | | | |
| | | Polymeric dispersant (4) *9 | | | | | |
| | | (cation exchange capacity 190$CaCO_3$ mg/g) | | | | | |
| | | Polymeric dispersant (8) *13 | | | | | |
| | | (cation exchange capacity 224$CaCO_3$ mg/g) | | | | | |
| | | Polymeric dispersant (9) *14 | | | | | |
| | | (cation exchange capacity 191$CaCO_3$ mg/g) | | | | | |
| | | Polymeric dispersant (10) *15 | | | | | |
| | | (cation exchange capacity 128$CaCO_3$ mg/g) | | | | | |
| | | Polymeric dispersant (11) *16 | | | | | 5 |
| | | (cation exchange capacity 14$CaCO_3$ mg/g) | | | | | |
| | | Polymeric dispersant (12) *17 | | | | | |
| | | (cation exchange capacity 121$CaCO_3$ mg/g) | | | | | |
| | | Polymer (3) *20 | 4.3 | | 2 | | |
| | | Polymer (4) *21 | | | | 5 | |
| | | Polymer (2) *19 | | 4.3 | 2.3 | | |
| | Step 2 | Zeolite (1) *25 | 10 | 10 | 10 | | |
| | | Zeolite (2) *26 | | | | 20 | 20 |
| | | Sodium carbonate | 8 | 8 | 8 | | |
| | Step 3 | Sodium percarbonate | 1 | 1 | 1 | | |
| | | Bleach-activating agent *22 | 0.7 | 0.7 | 0.7 | | |
| | | Ebalase 16. OL-EX *27 | 1 | 1 | 1 | | |
| | | Lipolase 1OOL *28 | 1 | 1 | 1 | | |
| | | Perfume | trace amount | ← | ← | ← | ← |

TABLE 3-continued

| | | | | | | |
|---|---|---|---|---|---|---|
| Evaluation results | The degree of separation by volume after 1 month (%) | 57 | 15 | 30 | 28 | 3 |
| | Degree of washing (%) | 77 | 76 | 77 | 77 | 62 |

*1 Nonionic surfactant (1): Softanol 70 (Nippon Shokubai Co., Ltd.)
*2 Nonionic surfactant (2): Emulgen 108 (Kao Corporation)
*3 Nonionic surfactant (3): Polyoxyethylene phenyl ether (PHG-30, produced by Nippon Nyukazai Co., Ltd.)
*4 Anionic surfactant: Sodium alkyl benzene sulfonate having $C_{10-14}$ linear alkyl group
*5 Water-soluble organic solvent: 1,3-butanediol (Wako Pure Chemical Industries, Ltd.)
*6 Polymeric dispersant (1): A lyophilized product of Aquarock FC600S (40% aqueous solution of polyethylene glycol (number of moles of EO added: 10) monomethacrylate/methacrylic acid (molar ratio 38/62) copolymer produced by Nippon Shokubai Co., Ltd.; cation exchange capacity, 26 $CaCO_3$ mg/g).
*7 Polymeric dispersant (2): Dispersant synthesized in Synthesis Example 1
*8 Polymeric dispersant (3): Dispersant synthesized in Synthesis Example 2
*9 Polymeric dispersant (4): Dispersant synthesized in Synthesis Example 3
*10 Polymeric dispersant (5): Dispersant synthesized in Synthesis Example 4
*11 Polymeric dispersant (6): Dispersant synthesized in Synthesis Example 5
*12 Polymeric dispersant (7): Dispersant synthesized in Synthesis Example 6
*13 Polymeric dispersant (8): Dispersant synthesized in Synthesis Example 7
*14 Polymeric dispersant (9): Dispersant synthesized in Synthesis Example 8
*15 Polymeric dispersant (10): Dispersant synthesized in Synthesis Example 9
*16 Polymeric dispersant (11): Dispersant synthesized in Synthesis Example 10
*17 Polymeric dispersant (12): Dispersant synthesized in Synthesis Example 11
*18 Polymer (1): Polyethylene glycol (polyethylene glycol 2,000, produced by Wako Pure Chemical Industries, Ltd.); cation exchange capacity, 9 $CaCO_3$ mg/g
*19 Polymer (2): Polyvinyl pyrrolidone (K-30, produced by Wako Pure Chemical Industries, Ltd.); cation exchange capacity, 12 $CaCO_3$ mg/g
*20 Polymer (3): Sodium polymethacrylate (weight average molecular weight of 9,500, produced by Aldrich); cation exchange capacity, 175 $CaCO_3$ mg/g
*21 Polymer (4): Poly(acrylic acid/maleic acid) (Sokaran CP-5, produced by BASF) ; cation exchange capacity, 380 $CaCO_3$ mg/g
*22 Bleach-activating agent: A bleach-activating agent represented by formula (IV) above
*23 Crystalline silicate compound (1): SKS-6 (produced by Hoechst)
*24 Crystalline silicate compound (2): Crystalline silicate compound described in Example 1 in JP-A 5-184946
*25 Zeolite (1): Toyo builder (produced by Tosoh Corporation) previously dehydrated by calcination at 450° C. for 1 hour
*26 Zeolite (2): Toyo builder (produced by Tosoh Corporation)
*27 Ebalase 16.0L-EX: Protease (produced by Novo Nordisk Bioindustry Ltd.)
*28 Lipolase 100L: Lipase (produced by Novo Nordisk Bioindustry Ltd.)

As can be seen from Tables 1, 2 and 3, the liquid detergent compositions of the present invention allow a mixture of the solid components including the crystalline silicate compound and/or aluminosilicate compound to be stably dispersed by use of the polymeric dispersant, thus reducing the degree of separation by volume after 1 month to 5% or less and exhibiting excellent detergency. In particular, when the total volume of phase (a) and component (c) was 0.9- to 1.1-fold relative to the volume of the gaps of media which were introduced into a media mill at the time of production, the degree of separation by volume can be further reduced.

What is claimed is:

1. A liquid detergent composition, having a degree of separation by volume of 5% or less after 1 month of storage at 25° C., comprising a liquid phase (a), a polymeric dispersant, which is a block or graft polymer comprising a polymer chain being soluble or uniformly dispersible in the phase (a) and a polymer chain having a functional group having a good affinity with the component (c), which include a carboxyl group, sulfonic acid group, phosphoric acid group or quaternary ammonium group as a component (b) and at least one member selected from the group consisting of a crystalline silicate compound and an aluminosilicate compound as a component (c), wherein the component (b) has a cation exchange capacity of not less than 120 $CaCO_3$ mg/g when either (i) the water content of the composition is 5% by weight or less and then the aluminosilicate compound only is used as the component (c), or (ii) the water content of the composition is larger than 5% by weight.

2. The liquid detergent composition according to claim 1, wherein the content of the phase (a) is 30 to 95% by weight of the composition.

3. The liquid detergent composition according to claim 1 or 2, wherein the phase (a) comprises 10 to 100% by weight of a surfactant.

4. The liquid detergent composition according to the claim 1, wherein the content of the component (b) is 0.1 to 10% by weight of the composition.

5. The liquid detergent composition according to the claim 1, wherein the content of the component (c) is 3 to 69.9% by weight of the composition.

6. The liquid detergent composition according to the claim 1, wherein the component (c) is the crystalline silicate compound represented by formula (I):

$$(M^1_pM^2_qM^3_r,O)(M^4_sM^5_t,O)_x(SiO_2)_y \quad (I)$$

wherein $M^1$, $M^2$ and $M^3$ represent Na, K or H; $M^4$ and $M^5$ represent Ca or Mg; p, q and r represent a number of 0 to 2, provided that p+q+r=2; s and t represent a number of 0 to 1, provided that s+t=1; x is a number of 0 to 1 and y is a number of 0.9 to 3.5.

7. The liquid detergent composition according to the claim 1, wherein the component (c) is the aluminosilicate compound represented by formula (II):

$$(M^1_pM^2_qM^3_r,O)_u(M^4_sM^5_t,O)_v(Al_2O_3)_w(SiO_2) \quad (II)$$

wherein $M^1$, $M^2$, $M^3$, $M^4$, $M^5$, p, q, r, s and t have the same meanings as defined above; u is a number of 0 to 1; v is a number of 0 to 1; and w is a number of 0 to 0.6.

8. A process for producing the liquid detergent composition as defined in the claim 1, which comprises a step of wet grinding the components (b) and (c) in the phase (a) to obtain a slurry of finely pulverized solid components.

9. A process for producing the liquid detergent composition as defined in the claim 1, which comprises steps of wet grinding the component (c) in the phase (a) to obtain a slurry of finely pulverized solid component and adding the component (b) to the slurry.

10. The process according to claim 8 or 9, wherein the total volume of the phase (a), the component (c) and other solid components is 0.9 to 1.1 times as much as the volume of gaps of media introduced into a media mill at the step of the wet grinding.

11. The liquid detergent composition according to claim 1, wherein the component (c) is the crystalline silicate compound.

12. The composition of claim 1, wherein the polymer chain having a functional group having a good affinity with component (c) consists essentially of a vinyl monomer having a carboxyl group.

13. The composition off claim 1, wherein the monomers forming a polymer chain being soluble or uniformly dispersible in the phase (a) are alkylene oxide.

* * * * *